United States Patent [19]

Keller et al.

[11] 4,193,478

[45] Mar. 18, 1980

[54] ELEVATOR CONTROL SYSTEM AND METHOD

[75] Inventors: Vernon P. Keller; Don B. Alley, both of Sacramento; Steven T. Majoewsky, Placerville, all of Calif.

[73] Assignee: Elevator Industries, Sacramento, Calif.

[21] Appl. No.: 791,157

[22] Filed: Apr. 26, 1977

[51] Int. Cl.[2] ..... B66B 1/16

[52] U.S. Cl. ..... 187/29 R

[58] Field of Search ..... 187/29; 318/256, 264, 318/291, 293

[56] References Cited

U.S. PATENT DOCUMENTS

| | | | |
|---|---|---|---|
| 3,747,710 | 7/1973 | Winkler | 187/29 |
| 3,774,729 | 11/1973 | Winkler | 187/29 |
| 3,791,490 | 2/1974 | Smith | 187/29 |
| 3,851,734 | 12/1974 | Sackin | 187/29 |
| 3,857,077 | 12/1974 | Kasmer | 318/293 X |
| 4,037,688 | 7/1977 | Winkler | 187/29 |
| 4,069,898 | 1/1978 | Tosato et al. | 187/29 |

*Primary Examiner*—Gene Z. Rubinson
*Assistant Examiner*—W. E. Duncanson, Jr.
*Attorney, Agent, or Firm*—Flehr, Hohbach, Test, et al

[57] ABSTRACT

A method and apparatus for controlling the movement of one or more elevators in a hoistway. The apparatus includes a power control sub-system containing moving machinery for imparting motion to the elevator car and to the elevator car doors, together with a plurality of control contacts operating to actuate the moving machinery to urge the elevator car and the doors in appropriate directions. A number of selectable control contacts or switches are provided in the elevator car and at elevator floor landings. A supervisory control sub-system containing control programs is coupled to the power control sub-system for the purpose of reading input data from the moving machinery, control contacts, and selectable switches, and to provide instructions to the power control sub-system in accordance with the supervisory control programs, and the status of the selectable switches and the control contacts. The supervisory control sub-system includes a data memory for storing the input data, a program memory for providing ones of a plurality of predetermined program instructions, and a data processor serially storing data, addressing the program memory, reading the instructions, fetching stored data, and providing output control signals to the power control sub-system. The elevator car and door motion is controlled in accordance with the output control signals.

22 Claims, 16 Drawing Figures

ELEVATOR CONTROL SYSTEM AND METHOD

BACKGROUND OF THE INVENTION

The present invention relates to an elevator control system, and more particularly to such a system utilizing a data processor and providing programmable automatic elevator operation.

In the past, elevator control systems have required hard wired relay logic with numerous electrically conducting cables running the lengths of an elevator hoistway, together with a multiplicity of selectable electromechanical relays to obtain the desired elevator car selection and control. An alteration in elevator car response to selected control inputs and to control system relay status requires considerable hoistway cable stripping and replacement together with numerous changes in electrical connections. Maintenance and trouble shooting of conventional elevator control systems is time comsuming and requires access to the cables in the hoistway, the relay logic, and the associated electromechanical components. An improved elevator control system and method is desirable to reduce the amount of hard wiring and electrical connections in the elevator control systems, and to make available means for quickly and simply altering the manner in which the elevator car responds to control inputs.

SUMMARY AND OBJECTS OF THE INVENTION

Disclosed herein is a method and apparatus for imparting control to an elevator by providing control output signals to elevator indicator and drive components in response to elevator car command signals and elevator status survey. The apparatus includes input buffer means receiving the elevator car command and status survey signals and providing input data corresponding thereto. Output buffer means is provided which produces the control output signals in response to output data obtained through processing of the input data. The input and output data levels are comparatively low to afford compatibility with data processing circuitry, while the control output signals and command and status inputs are relatively high level, so that reliable operation of the drive components is obtained in the comparatively dirty environment of the elevator hoistway. Interface means receives and transmits the input and output data, and a data memory is coupled to the interface means to receive and store the input data. A program memory is also coupled to the interface means containing a plurality of program instructions therein. A data processor is coupled to the program and data memories and the interface means performing a series of operations on the input data in accordance with the program instructions and producing the output data to the output buffer means. The output data is addressed in accordance with the operation of the data processor to thereby obtain appropriate control output signals for the elevator.

A method is utilized in conjunction with an apparatus having a supervisory control system including a data memory storing input data, a program memory providing program instructions, and a data processor which serially processes stored input data in accordance with the program instructions to thereby provide output data. A power control system is also included in the apparatus including a hoist motor coupled to an elevator car in a hoistway, a door operator coupled to the doors on the elevator car, an automatic leveling device aligning the elevator car with appropriate floor landings, and power control system contacts utilized to interconnect power control system components and to couple the power control to the supervisory control system. The apparatus further includes hall and car selectable contacts and hall and car indicator lights. The method includes interrogating the selectable and power control system contacts with the data processor to obtain input data from the interrogation. Selecting an elevator car travel direction dependent on the contact interrogation results in motion of the elevator car into a floor landing in accordance with the selectable contact interrogation. Leveling the elevator car at the floor landing is in accordance with the characteristics of the automatic leveling device. Call cancellation occurs for selected car contacts in the order in which the corresponding floor landings are reached without regard for the direction of car travel, and occurs for selected hall contacts in the order in which the selected floor landings are reached in accordance with the direction of car travel. Thereafter the steps of determining a subsequent elevator car travel direction is performed, dependent upon output data. Actuating of the door operator to open and hold the elevator car doors open for a predetermined time is followed by actuation of the door operator to urge the elevator car doors closed. The method further includes moving the elevator car from the floor landing to which it had been leveled at an operating speed determined by the data output. Energizing and cancelling of selected hall and car indicator lights is also performed in accordance with output data.

It is an object of the present invention to provide an elevator control system which is universal in application to single or multiple elevator car installations to thereby obtain any desired operating performance through removal and replacement of modular control circuits.

It is another object of the present invention to provide an elevator control system wherein the control signals and data are isolated so that each may be optimized for compatibility with electro-mechanical components and micro-electronic circuit components respectively.

Another object of the present invention is to provide an elevator control system which is expandable to increase system capability through a modular concept.

Another object of the present invention is to provide an elevator control system in which system operation changes may be made by merely reprogramming stored program variables.

Another object of the present invention is to provide an elevator control system which is compatible with existing elevator intallations and is capable of replacing electro-mechanical relay banks for control without replacing high cost electrical drive machinery.

Additional objects and features of the invention will appear from the following description in which the preferred embodiments of the invention have been set forth in detail and in conjunction with the drawings.

DESCRIPTION OF THE PREFERRED EMBODIMENTS

The elevator control system disclosed herein includes two major sub-systems termed the Power Control Sub-System and the Supervisory Control Sub-System. The overall control system is designed to control an elevator car in a hoistway for a multi-floor building to cause the elevator car to approach and stop at floor landings in the building in accordance with command inputs to the system through selectable contacts or switches in the car and at the floor landings. Some elevator control systems utilize single selectable switches at each floor landing for calling a car to the floor. The system disclosed herein will be described in association with a pair of selectable call switches at each floor landing, one for an up-call and one for a down-call. The selectable switches at the floor landings produce what are termed "hall calls" upon actuation. Each individual elevator car has a panel inside containing selectable contacts or switches, one for each floor landing. Actuation of one of the floor select switches in the elevator car produces what is termed a "car call". The elevator car control envisioned through the use of the invention disclosed provides what is described as selective collective, automatic operation. Such operation is generally described as being obtained by means of one selectable switch in each elevator car for each floor landing served and by a pair of floor landing or hall selectable switches, one for up and one for down at each of the floor landings. All stops for calls registered by the momentary actuation of elevator car selectable switches or contacts are made without regard to the number of car contacts actuated or of the sequence in which the car contacts were actuated. The elevator car stops at all floor landings for which car contacts have been actuated, making the stops in the order in which the floor landings are reached after the buttons have been actuated without regard for the direction of travel of the elevator car. The stops for calls registered by the momentary actuation of the selectable hall or floor landing contacts are made in order in which the landings are reached in each direction of travel after the hall contacts have been actuated. Up hall calls are answered when the car is traveling in the up direction and down hall calls are answered when the elevator car is traveling in the down direction.

Figure 1:
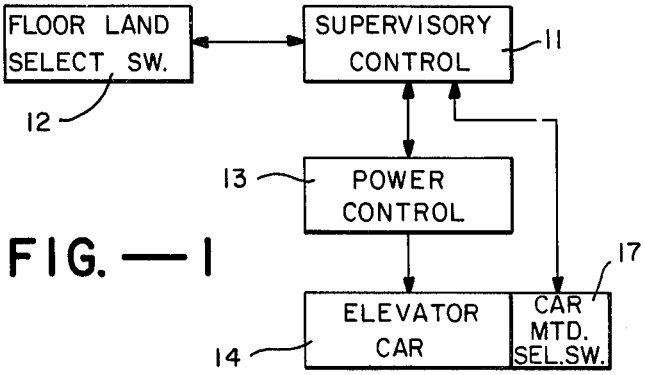
FIG. 1 is a block diagram of the elevator control system.

FIG. 1 shows supervisory control 11 coupled to receive information related to the actuation of selectable floor landing switches 12. Supervisory control system 11 is coupled to power control system 13, transmitting information to and receiving information from supervisory control system 11. Power control system 13 provides the signals coupled to driving machinery for operating an elevator car 14 in the hoistway. As discussed above, a control panel is located in the elevator car 14 on which are disposed a plurality of car mounted select switches 17 for selection of floor landings from within the elevator car 14. The car mounted select switches 17 provide switch contact data which is coupled to supervisory control system 11, and in turn receive energizing signals from supervisory control system 11 for illumination of contact status lights associated with each of the car select switches 17. In similar fashion the floor landing located select switches 12 producing hall calls, provide switch contact status information to supervisory control 11 and receive energy for lights associated with the switches 12 which indicate the contact status. For purposes of brevity, floor landing select switches 12 located at the landings and car located select switches 17 located in the elevator car 14 will be referred to as hall call switches 12 and car call switches 17 hereinafter.

Figure 2:
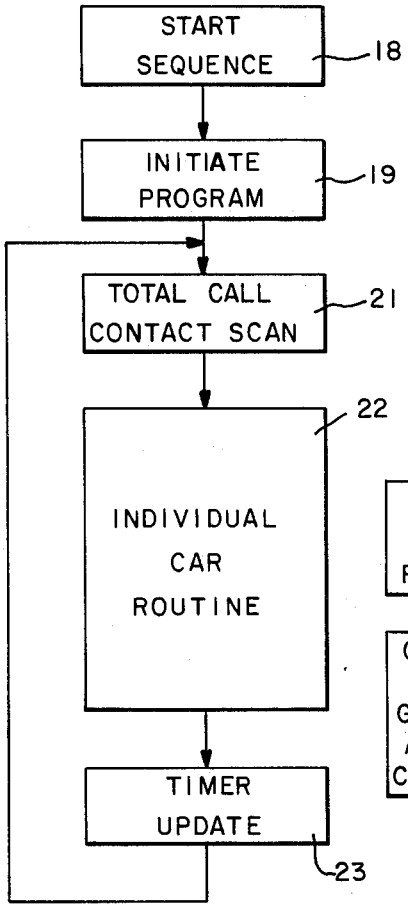
FIG. 2 is a program flow diagram of the elevator system of FIG. 1.

FIG. 2 is a program flow chart showing the manner in which the system of FIG. 1 controls a single elevator car 14. A start sequence 18 resets supervisory control 11 effectively removing all previously obtained input data and thereafter a program initiation sequence occurs which undertakes a search for the position of the elevator car 14. A "find car" routine is included in the program initiation which checks contacts actuated by the position of the elevator car 14 in the hoistway to see if the elevator car 14 is at the top floor landing or at the bottom floor landing. If elevator car 14 is at one of these positions in the hoistway the supervisory control system 11 is set to reflect the proper elevator car position. If the elevator car 14 happens to be in mid-hoistway when power is first applied to the system, supervisory control system 11 will produce a phantom call to the power control system and run elevator car 14 until it reaches a terminal floor landing. The phantom call may be an up or down call depending on system requirements. At this point the indicator for terminal elevator car position will produce a signal received by the supervisory control system 11 and the position of elevator car 14 will become synchronized with the supervisory control system 11.

Following the start up and initiate program sequence 18 and 19, supervisory control system 11 undertakes a floor landing contact scan 21 and then enters into individual car routine 22. Following the individual car routine 22 there occurs a timer update sequence 23 for all timers in the system. Following the timer update, the program flow returns to the floor landing contact scan sequence 21 to repeat the individual car routine 22 and timer update 23 continuously while the system is energized.

Figure 3:
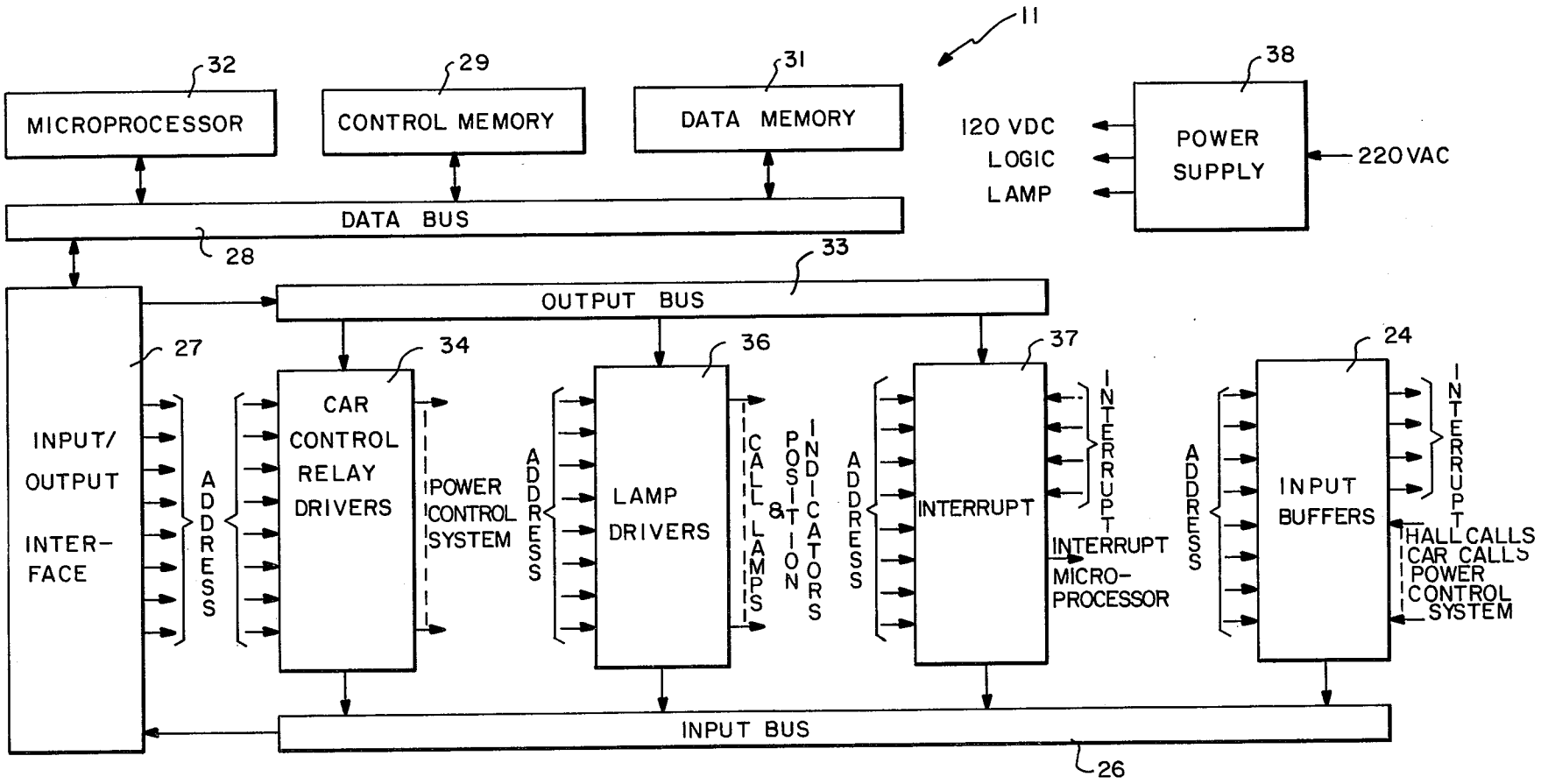
FIG. 3 is a block diagram of a supervisory control system.

A block diagram of the supervisory control system 11 is shown in FIG. 3 of the drawings. A number of input buffers 24 are shown having a number of inputs thereto including hall calls from hall call switches 12 and car calls from car call switches 17 together with other signals from the power control system to be hereinafter described. Input buffers 24 produce input data which is placed on an input bus 26.

An input/output interface section 27 is coupled to the input bus to receive the input data therefrom and pass the input data to an internal data bus 28. A control memory 29 having a plurality of predetermined program instructions therein is coupled to internal data bus 28 to provide selected program instructions thereon. A data memory 31 is coupled to internal data bus 28 for the purpose of receiving input data from data bus 28, storing the input data therein, and releasing the stored input to the internal data bus 28 on command. A microprocessor 32 is also coupled to internal data bus 28 providing serial operations upon the information on internal data bus 28. Microprocessor 32 processes the data on internal data bus 28 by serially directing that input data be passed thereto through input/output interface 27, storing the input data in data memory 31, instructing the control memory 29 to provide program instructions to the internal data bus 28, fetching stored input data from data memory 31 in accordance with the program instructions, and passing the resulting information as output data through input/output interface 27 to an output bus 33. Microprocessor 32 also provides stored information from data memory 31 to input/output interface 27 which results in an address output.

A number of car control relay drivers 34 are provided, coupled between output 33 and input bus 26. Output data from output bus 33 is therefore connected to car control relay drivers 34. The address from input/output interface 27 is connected to car control relay drivers 34 for the purpose of addressing certain of the output data from output bus 33. The address output connected to output buffers 34 serves to enable addressed output data so that control output signals are obtained through enabled paths in output buffers 34 for coupling to the power control system 13. A number of lamp drivers 36 are provided connected between the output bus 33 and the input bus 26, receiving output data and also being addressed by the input/output interface 27. In this fashion addressed output data is enabled at lamp drivers 36 to provide energizing signals for hall switch and elevator travel indicators at the floor landings as well as car switch actuators and floor position indicators within the elevator car 14.

An interrupt circuit 37 is provided which is coupled between output bus 33 and input bus 26, which receives address information from input/output interface 27. It should be noted that input buffers 24 produce interrupt outputs in response to input signals from power control system 13 which are connected to interrupt circuit 37. Addressed output data is combined in interrupt circuit 37 with interrupt information obtained from input buffers 24 for the purpose of producing an appropriate interrupt signal to microprocessor 32. A power supply 38 is shown in FIG. 3 serving to provide relatively high 120 volt DC power to hoistway components, relatively low logic voltage level for the internal circuitry of supervisory control system 11, and an indicator lamp energizing signal. Supervisory control system 11 consequently functions as follows. Microprocessor or data processor 32 performs a series of repeating operations on information on internal data bus 28. Data processor 32 operates to command input/output interface 27 to transfer input data from input bus 26 to internal data bus 28, after which it instructs data memory 31 to receive and store the data on internal data bus 28. Thereafter data processor 32 addresses control memory 29 causing a specific program instruction to appear on data bus 28. Stored data in data memory 31 is fetched by one of the serial operations of the data processor 32 which is operated upon by the program instructions from control memory 29. The resulting data is thereafter passed by input/output interface 27 from data bus 28 to output bus 33 where it appears as output data. Data processor 32 instructs input/output interface 27 to produce an address coupled to relay drivers 34, lamp drivers 36, interrupt circuit 37, and input buffers 24 to enable output data to thereby produce the desired control output signals for power control system 13.

Figure 4:
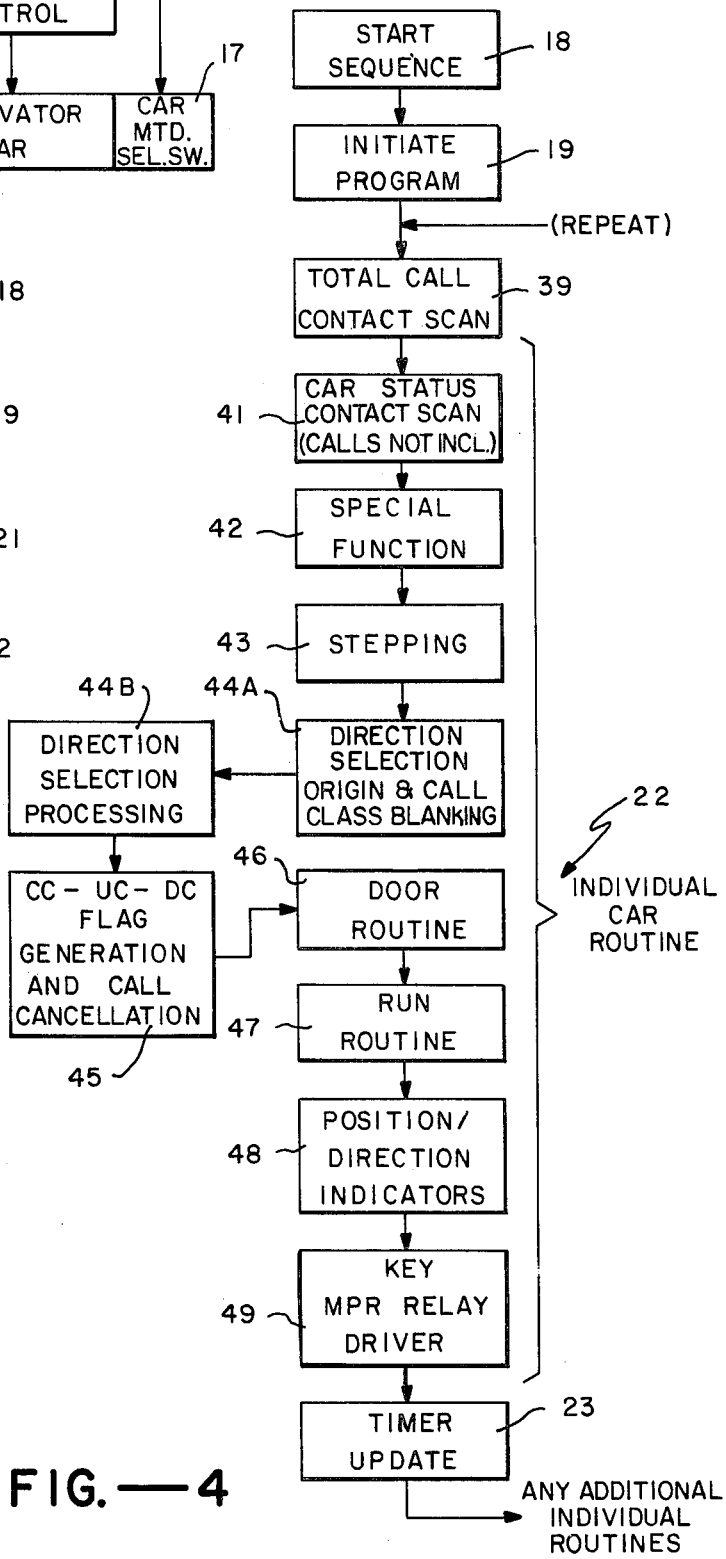
FIG. 4 is a program flow diagram for an individual elevator car.

FIG. 4 is a program flow diagram showing the individual car routine 22 in greater detail as it is performed by the supervisory control system of FIG. 3. Start sequence and intiate program sequence 18 and 19 respectively are as recited in the description of the program flow diagram of FIG. 2. A total call contact scan 39 is performed for all of the hall call switches 12 and the car call switches 17 for up to two cars. Thereafter, the individual car routine 22 is entered by performing a car status contact scan 41 which involves reading the condition of power control system relay and switch contacts such as doors open and closed, car running up or down, safety system normal, etc., as well as user selectable switches relating to the operation of the elevator car such as a door open button or on independent service switch. Also included in the car status contact scan is the reading of inputs pertaining to the car's position in the hoistway, such as floor position incrementing or decrementing inputs, sometimes referred to as the stepping inputs. The total call contact scan and the car status contact scan together amount to a "snap shot" of all of the conditions of the select switches relays, limit switches, etc., which pertain to the complete status and operating commands (including all calls) of the elevator system. These two interrogation routines, total call contact scan 39 and car status contact scan 41, obtain information upon which the supervisory control system thereafter acts. A bit position is provided in the data memory for each input. This is the only time during a program routine cycle when outside information is read and taken into the supervisory control system 11. The program routine cycle includes total call contact scan 39, timer update 23, and all subroutines therebetween, as shown in FIG. 4. During the remainder of the program flow after contact scan the programs within the supervisory control system 11 operate on the inputs existing at the time of the contact scan routines and which are subsequently stored in the data memory 31. This scheme is followed to "stop action" the input data until one complete program flow cycle can be completed.

After performance of car status contact scan 41 a special function observation 42 is made which usually includes observation of a number of inputs such as an earthquake sensing system and/or a fire detection system. Earthquake sensing systems and fire detection systems are known and somewhat standardized, are not a part of this invention and will not be described in detail here. Suffice it to say they each produce signals in response to the detection of earthquake or fire which are observed at this point in the program flow and which alter the operation of the elevator car 14 in response to the specific emergency situation sensed. For example, when an earthquake indicative signal is provided, elevator car 14 is controlled to immediately assume slow speed and to proceed at the slow speed in the present direction of travel to the next floor. Upon reaching the floor the door opens and the car stops. When a fire indicative signal is received by the supervisory control system the elevator car 14 is controlled to return non-stop to the lobby floor disregarding all hall calls currently registered. Setting up conditions for any operation other than absolute normal is the purpose of the special function routine 42.

The next block in the program flow diagram of FIG. 4 involves the stepping routine 43. The system disclosed herein has no mechanical floor selector. After the elevator car 14 and the supervisory control system 11 are synchronized, the position of elevator car 14 in the hoistway is constantly monitored by means of switches described in conjunction with FIG. 11 which sense passing each floor landing. The switches update the supervisory control system 11 so that the position of elevator car 14 is always known. This process shall be known as stepping. If a call for which the car is eligible is registered for a specific floor landing, a slow-down is initiated at a specified distance prior to reaching the floor landing by program routines other than stepping. Elevator car 14 is then "leveled" with the selected floor landing by a portion of the power control sub-system that operates independently of the supervisory control sub-system. It should be noted that all functions dealing with keeping the indicated floor position synchronized with actual floor position in the building is also the responsibility of the stepping routine.

As previously described the elevator control system disclosed herein will provide selective collective, automatic operation. To implement the majority of logic necessary for this operation requires the inclusion of the direction selection and call blanking routine 44A, the direction selection processing routine 44B, and the CC-UC-DC flag generation and call concellation routine 45. The direction selection origin and call class blanking routine 44A produces all the program flags that indicate the basic recognition and the origin of calls whether above or below the position of the elevator car and the type of call whether car calls or hall calls. The "blanking" of production of these flags will occur due to production of certain flags in the special function routine. Certain data bits called "squelch" bits which are produced under specific conditions if the elevator system contains more than one car also produce "blanking" of production of the above mentioned flags. The direction selection processing routine 44B takes the flags produced in the direction selection origin and call class blanking routine 44A, other information produced in the special function routine 42, and the direction preference flags produced in the CC-UC-DC flag gernation and call cancellation routine 45 and combines these in such a fashion as to produce a final pair of flags whose signals are routed to the input/output interface 27, the output bus 33 and finally to the relay drivers 34 where the signals emerge as "supervisory up" and "supervisory down" signals suitable for driving the power control sub-system 13 directly. Thus, the direction selection processing routine 44B processes logic signals dealing with demands for service and produces the signal corresponding to the desired direction of travel.

The CC-UC-DC flag generation and call cancellation routine 45 checks for logic bits signifying the existance of an uncancelled call or call button pressed *only* for the floor corresponding to the position of the elevator. The significance of the CC-UC-DC flags are that they identify the type of call to be recognized and cancelled (CC for car call, UC for up call, DC for down call). These flags are used to establish the proper door time in the door routine 45 and to initiate a slowdown sequence in the run routine 47. Also, the UC and DC flags produce other flags which establish a direction preference that is accessed during the direction selection processing routine 44B on subsequent program cycles. This has the effect of holding the direction selection logic in the proper direction due to a cancelled hall call in order to give the passenger time to establish the car call for his desired direction of travel. Otherwise, the possibility exists that there may be demand for service in the direction opposite that of the just cancelled hall call and with no car calls or other demand yet established in the direction of the cancelled hall call, the direction selection logic would be liable to be selected for the opposite direction. The direction preference logic is released at the point where the doors begin to close, thus one "hall call door time" is given to the passenger to establish his car call before the direction selection logic is free to respond to system demands. It is a function of selective-collective elevator operational requirements that once a direction of travel is established, all demand in that direction must be cleared before the opposite direction can be selected. In this way one direction must necessarily "lock out" the other; thus the necessity for the direction preference function is clearly established. The next main logic block in the overal individual car routine 22 is the door routine 46. This is one of the lengthiest and most complicated of the routines and exists solely for the purpose of producing the logic for controlling the operation of the elevator doors. The logic flow has five major branches, the first of which is the shortest and has the function of rendering the doors inoperative in terms of processor control whenever the elevator is under access or inspection operation i.e., under manual control by a qualified serviceman. The second program branch is entered under the condition that the supervisory control system has recognized that an earthquake has occurred and an unsafe condition exists on the elevator counterweight assembly (if the elevator is an electric traction type). Under this condition the car doors will offer an appropriate delay and if the car is within a few inches of being level with the floor, open the doors and keep them open, not allowing further use of the elevator under potentially unsafe conditions. The third and fourth program branches deal with the two types of special door operation that are required when the supervisory control system 11 receives information that a fire exists in the building. The logic is set up such that door operation under the fire emergency condition conforms to appropriate State and local codes and safety orders. The fifth and final primary branch in the door routine 46 details the operation of the doors under normal conditions and includes options for different lengths of time or "door times" that the elevator doors are allowed to stand open while the car is stopped at a floor. These door times are selected depending on what kind of a call has been answered or whether a direct signal to open the doors has been initiated such as would be intiated by the door open button, etc. The various programmable door times are under software control and do not involve analog functions.

The run routine 47 contains the logic responsible for the selection of speeds that the elevator will attain while actively running in the full automatic mode. The decision to leave the floor in response to demand for service is made in this routine. If the elevator is standing at a floor with the doors open, the only decision this routine may make is whether regular or high leveling speed is selected when the car is leveling. (Leveling is the process of keeping the car in the vicinity of the floor when appropriate.) If the car is running the decision to slow down is initiated in this routine (drop "high" speed and select the next lower speed). If the elevator is capable of relatively high speed, another speed may be used as a "high intermediate" speed and this routine will seek the intermediate stepping inputs from the vane-actuated magnetic switches ISTU and ISTD 134 during a slowdown from high speed for the purpose of dropping "high intermediate" speed. It should be noted here that only the selection of basic speeds is the function of the logic contained in the run routine 47 while smooth accelerations and decelerations are handled by the power control 13. In fact, the initiation of a run between two floors is accomplished by selecting high speed directly, plus a direction, and letting the power control 13 generate all signals necessary for a smooth transition to that high speed.

In the position/direction indicator routine 48 the program flow provides update of position and direction indicators plus any other auxilliary indicator signals which are not related to hall or car calls. For example, car position indicators in the halls or in the elevator car 14, and hall and car direction of motion indicators are updated. The last function performed in the individual car routine 22 is the microprocessor running (MPR) relay driver key function 49, which occurs once each program cycle to retain power on the MPR relay which provides 120 VDC power for all other relay drivers 34. Following individual car routine 22, all timers in the supervisory control system 11 are scanned and each active timer is advanced by an incremental time when appropriate. These timers are found in locations in data memory 31 and are set to time out after receiving a predetermined number of incremental time updates. In this fashion certain timing functions associated with the elevator control system are performed. In a two-car system, another individual car routine 22 will be accomplished after the timer update 23. The program function loop is now complete and the data processor 32 begins anew with total contact scan 39. The whole loop is repeated a number of times each second so that operation is continuous to outward appearance. The design method embodied in this approach is that no matter what function the supervisory control 11 is performing, all routines are routed through on each program loop, and the majority of outputs are reestalished, both for relay drivers 34 and lamp drivers 36 once per loop. This may appear to be an inefficient way of operating the system but it provides a large measure of self correction and inherent noise immunity in a very harsh environment. Extensive in-use experience has proved that this makes the control system very forgiving and tolerant of the elevator system environment. The seeming inefficiency in handling the program is not as severe as might be expected since, on the average, the amount of time spent in a particular program routine will be largely dependent on the activity and complexity of functions being performed. For example, if the elevator were standing at a floor operating the doors, the amount of program loop time spent in the door routine 46 would be considerable while the time spent in the run routine 47 would be likely to be somewhere near the minimum possible. Thus, the software as well as the hardware has been designed with reliability, and ultimately safety, as the guiding criteria.

Figure 5:
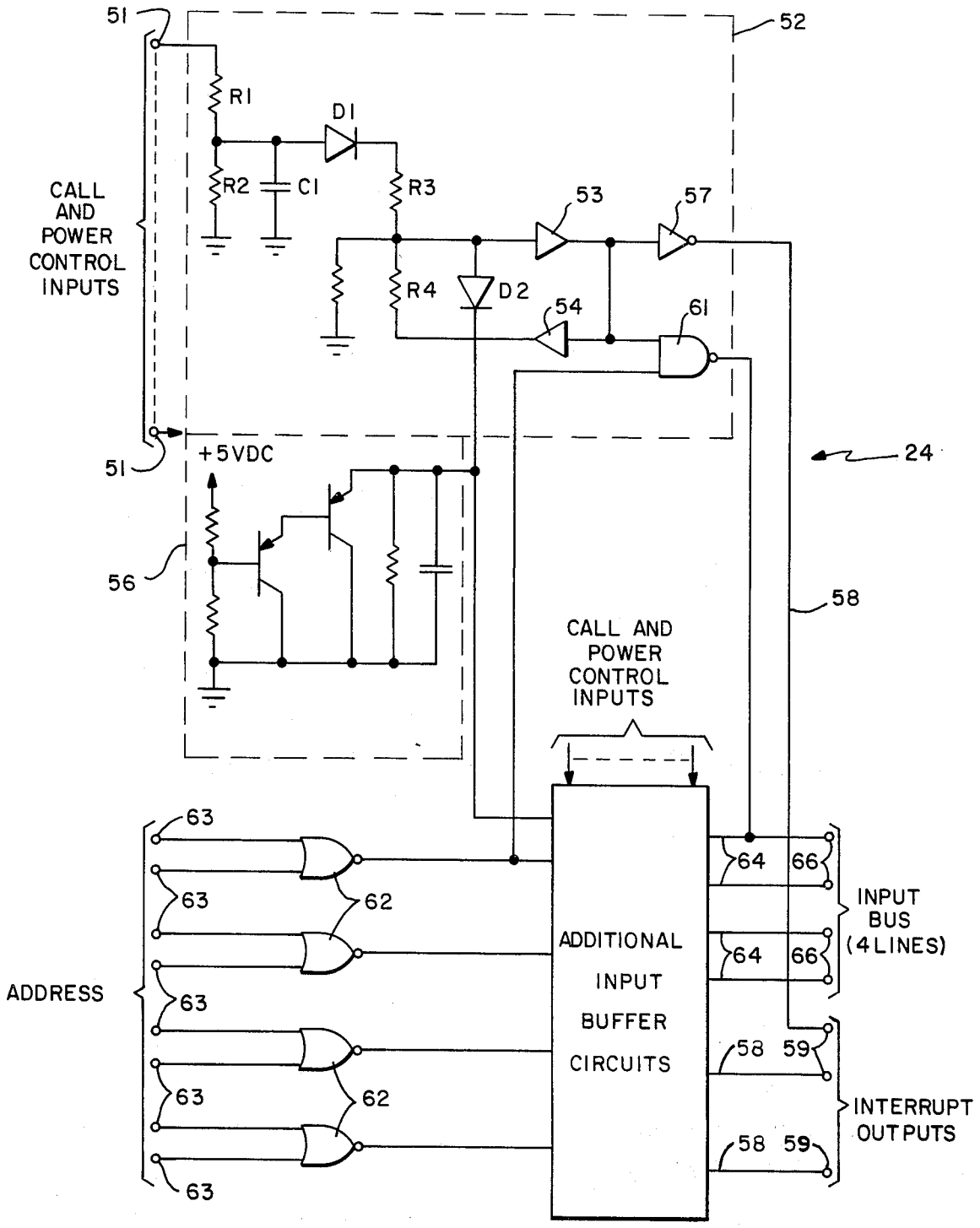
FIG. 5 is an electrical schematic diagram of an input buffer circuit.

FIG. 5 is a schematic diagram showing the circuit details of an input buffer board having a plurality of input terminals 51 for receiving inputs from hall call and car call switches 12 and 17 respectively, as well as a plurality of inputs from power control system 13. A single input buffer path 52 is shown having an input attenuator shown as a voltage divider containing resistance R1 and R2 to drop the 120 volt DC external inputs to about 20 volts DC at the cathode of diode D1. A capacitor C1 is connected between the anode of diode D1 and ground reference for the purpose of providing a low pass filtering effect to remove high frequency noise which may be present at the input signal terminal 51. A signal is thereafter passed through resistor R3 to the input of non-inverting buffer amplifier 53 which has a positive feedback path therearound through non-inverting amplifier 54 and resistor R4. The positive feedback is for the purpose of obtaining fast rise time in the signal at the input to non-inverting amplifier 53 upon reaching the amplifier threshold. A four volt clamp 56 is coupled to the input of non-inverting amplifier 53 through a diode D2 for the purpose of protecting the amplifier.

The output of non-inverting amplifier 53 follows the input to input terminals 51. An inverting amplifier 57 receives the output of non-inverting amplifier 53 connecting the inverted output to an interrupt line 58. In this embodiment each of the interrupt lines 58 originates from a particular input buffer path 52, thereby providing one unique interrupt output appearing on one of the terminals 59, which are located on the backplane of each input buffer circuit 24 where one interrupt output exists for each input signal terminal 51. The output of non-inverting buffer amplifier 53 is also connected to one input of a NAND gate 61 having its other input connected to the output of NOR gate 62. NOR gate 62 receives a pair of address inputs at input terminals 63 providing an output which, in this embodiment, is connected to the inputs of three additional NAND gates 61 (not shown) as part of three additional input buffer paths 52. With an address input at address terminals 63, NOR gate 62 produces an enabling output to NAND gate 61 which provides an input data output connected to one of four lines 64 in input bus 26. Any NOR gate 62 can place four input buffer paths 52 at a time on line to input bus 26. Input bus terminals 66 are shown in FIG. 5. Each input buffer circuit 24 of FIG. 5 is configured to receive call and power control inputs at terminals 51, 8 address inputs at terminals 63, provide for interrupt outputs at terminals 59, and provide four bits of input data on lines 64 which are coupled to input bus 26. Additional input buffer circuit paths 52 are shown included in the circuit of FIG. 5 to obtain the foregoing capability. In a complete elevator control system, a plurality of such circuits is normally used.

Figure 6:
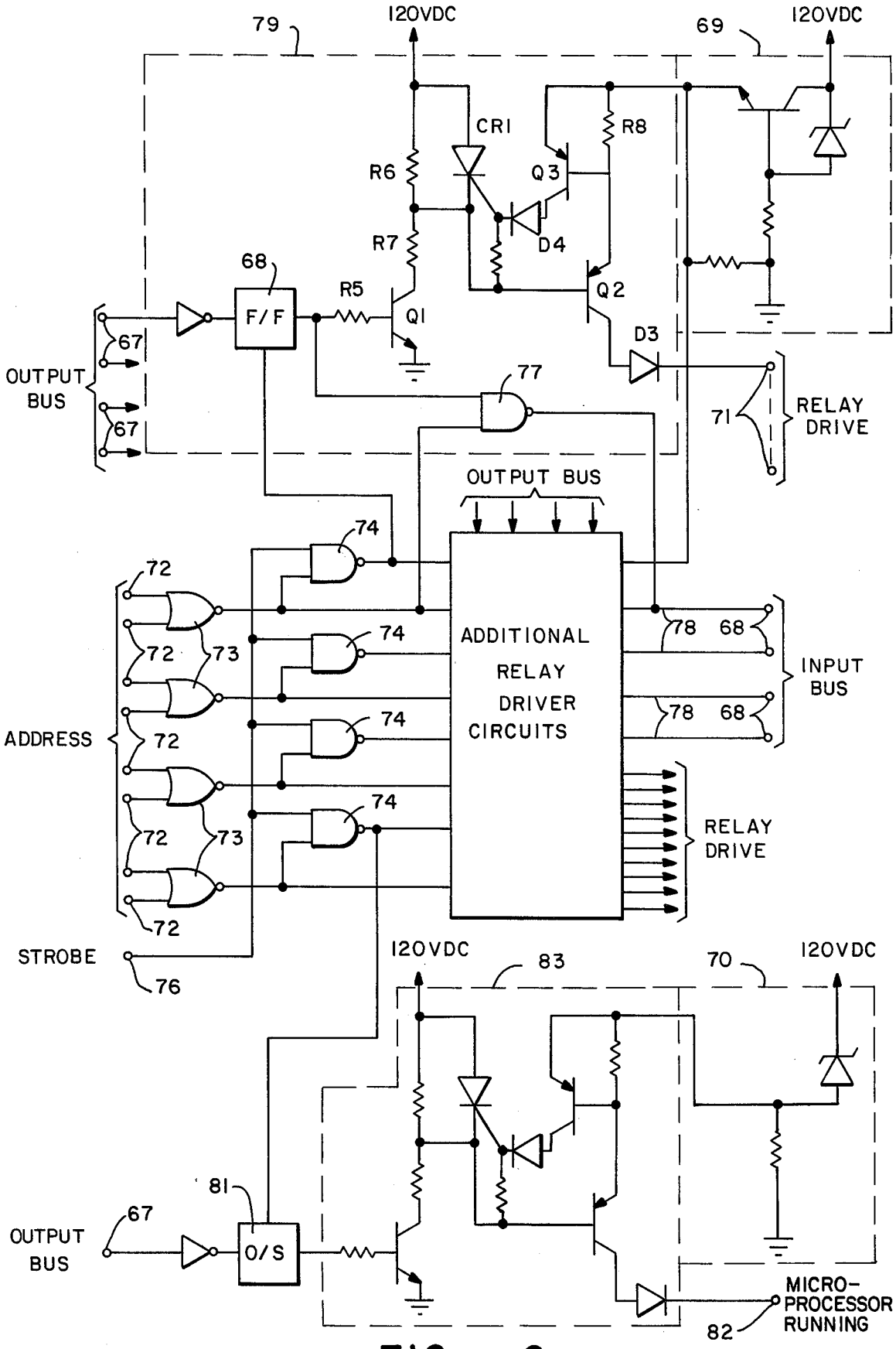
FIG. 6 is an electrical schematic diagram of a relay driver or output buffer circuit.

FIG. 6 portrays a circuit diagram for relay drivers 34. As seen in FIG. 3, the circuit of FIG. 6 is connected to the output bus 33 at terminals 67 and the input bus 26 at terminals 68. Output data is delivered from one of the terminals 67 to a flip-flop 69 which is thereby set, effectively storing the bit of output data, and producing an output through resistor R5 to the base of transistor Q1. When transistor Q1 is turned on by the output from flip-flop 68, the signal level at the base of transistor Q2 is dropped through voltage division in series resistors R6 and R7 to turn transistor Q2 on. When transistor Q2 is turned on, output current flows through R8, Q2, D3 to terminals 71. An offset voltage is obtained from a voltage regulator 69 which provides power for a relay driver output at terminals 71 when Q2 is turned on. Diode D3 protects the circuit from inductive loads attached to terminals 71 when such loads are de-energized. It may be seen that when the output from flip-flop 68 is removed from the base of transistor Q1, transistor Q2 is turned off. If excess current is drawn through the string of devices consisting of R8, Q2, and D3, the voltage drop across R8 will bias on Q3 through D4 and in turn provide gate drive for CR1. CR1 will then fire and reverse bias the base of Q2, shutting off Q2 and protecting the circuit 79 from overload.

The manner in which flip-flop 68 is caused to produce an output to the base of transistor Q1 involves the application of address signals to address terminals 72 in the relay driver and output buffer circuit 34. The address outputs from input/output interface 27 are connected to address terminal 72 which are at the inputs of NOR gates 73. A pair of low state signals at input terminals 72 to a NOR gate 73 provides a high state output which is coupled to one of the inputs of respective NAND gates 74. The output of only one NOR gate 73 at a time should be high. A strobe output which is controlled by the serial functions of data processor 32 is presented at strobe terminal 76 which is connected to another input to NAND gate 74. A low state is provided at the output of NAND gate 74 coupled to flip-flip 68 to thereby select and latch the datum appearing on one of the output bus terminals 67 into flip-flop 68 to thereby produce the desired control output signals at relay driver terminal 71. The output of flip-flop 68 is also connected to one input of a NAND gate 77. The output of NOR gate 73 is connected to another input at NAND gate 77. When the NOR gate 73 is addressed, the datum present on the output of flip-flop 68 appears as an output on open collector NAND gate 77 and provides a bit of input data coupled to one of four lines 78 connected to input bus terminals 68. Additional relay driver circuits are similar to circuit 79. Therefore, any strobed and addressed NAND gate 74 latches the four bits of data appearing on output bus terminals 67 into the flip-flops in up to four identical circuits 79 at a time. In addition, the same uniquely addressed NOR gate 73 that permitted this operation also places the outputs of those same flip-flops 68 in inverted form onto the four lines terminating in input bus terminals 68 by enabling the NAND gate 77 associated with each flip-flop. In this way, the data can be latched into the circuits 79 to drive the outputs 71 and/or the latched data can be read back into the processor 32 via input bus 26. Circuit 79 is therefore not only an output drive circuit, but a randomly access memory location. Again note that data is handled four bits at a time.

FIG. 6 also shows one output bus terminal 67 connected to the input of a retriggerable one-shot device 81. One-shot 81 is enabled by address to the appropriate address terminals 72 and triggered by a strobe signal at strobe terminals 76 through one of the NAND gates 74 as described above for enabling and actuation of flip-flop 68. The output from one-shot 81 has a predetermined dwell time which provides an output signal at a microprocessor running (MPR) relay drive terminal 82 having the dwell time of one-shot 81. A circuit 83 is seen to be coupled between one-shot 81 and MPR relay driver output terminal 82 which is similar to the portion of circuit 79 seen between flip-flop 68 and relay driver and output buffer terminals 71 described above. The circuit operation is the same as previously described. Also associated with circuit section 83 is another voltage level generator 70 similar to voltage regulator 69 mentioned above in association with output buffer single path 79. In one working embodiment, retriggerable one-shot device 81 provides a 300 millisecond dwell time output pulse. A routine for a single car elevator control system is completed by microprocessor 32 in about 150 milliseconds and such a routine is completed in about 250 milliseconds for a duplex car control system. A retrigger signal addressed through NOR gate 73 and with a strobe signal propagating through NAND gate 74 is coupled to the input of one-shot device 81 following the completion of each individual car routine 22, as seen in block 49 of FIG. 4. So, as long as the dwell time for one-shot 81 is longer than the total time around the program loop and providing a retrigger signal occurs once each loop, the one-shot 81 will never have time to elapse. This maintains power continuously on the micro-processor running (MPR) relay which couples power to the relay drivers 34 which operate the power control 13 for the elevator car 14 discussed hereinafter. Therefore, if a software or hardware breakdown occurs that causes the program to loop improperly or not at all, the MPR relay will drop out, removing power from the relay drivers and the car will stop immediately assuring additional safety.

Figure 7:
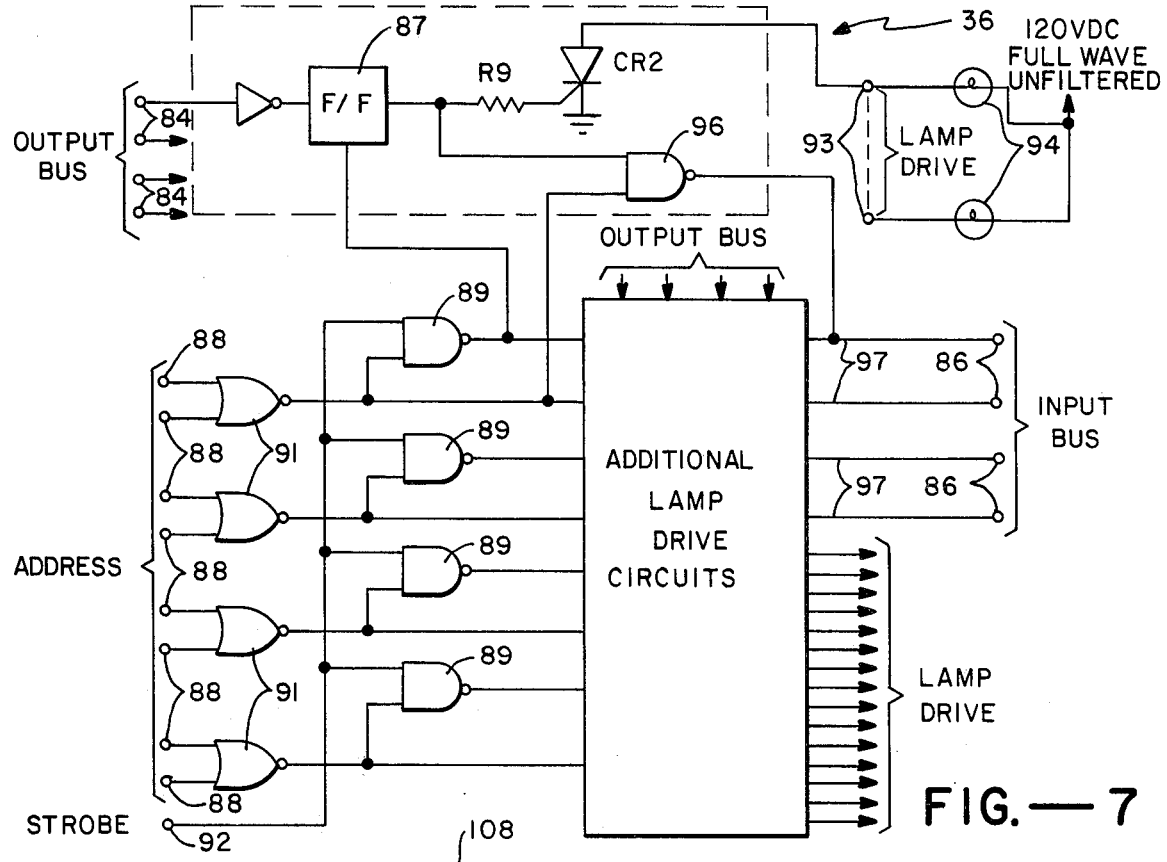
FIG. 7 is an electrical schematic diagram of a lamp driver circuit.

The schematic diagram of FIG. 7 shows the circuitry for lamp drivers 36 which are coupled between output bus 33 and input bus 26 through output bus terminals 84 and input bus terminals 86 respectively. Output data is provided to the input of a flip-flop 87 where it is latched as soon as enabled by the correct address output from input/output interface 27 coupled to address terminals 88. Flip-flop 87 produces an output upon receiving a clock input from NAND gate 89 resulting from output from NOR gate 91 having address terminals 88 connected to the inputs thereof, and a strobe signal connected to strobe terminal 92 in the manner described above for the corresponding components of FIG. 6.

Output from flip-flop 87 is provided to the gate of a controlled rectifier CR2 through a resistor R9. The anode of controlled rectifier CR2 is connected to lamp driver output terminal 93, in turn each being connected to a lamp 94 having a voltage applied thereto sufficient to illuminate lamps 94. When CR2 is turned on by the flip-flop signal at the gate, a complete circuit from a voltage source through the lamp to a reference or ground potential is provided, thereby illuminating the lamp 94. The output of flip-flop 87 is also connected to one input of a NAND gate 96 having the output of NOR gate 91 connected to another input thereon. Consequently, when enabled by address inputs to address terminals 88 NAND gate 96 transfers the latched output state of flip-flop 87 to one of four lines 97 attached to input bus terminals 86. In this fashion bits indicative of lamp condition are coupled to lines 97 and therefore to input bus 26. It is also shown in FIG. 7 that there are a number of additional driver circuits having output data connected thereto providing lamp drive signals and lamp driver output terminals.

Figure 8:
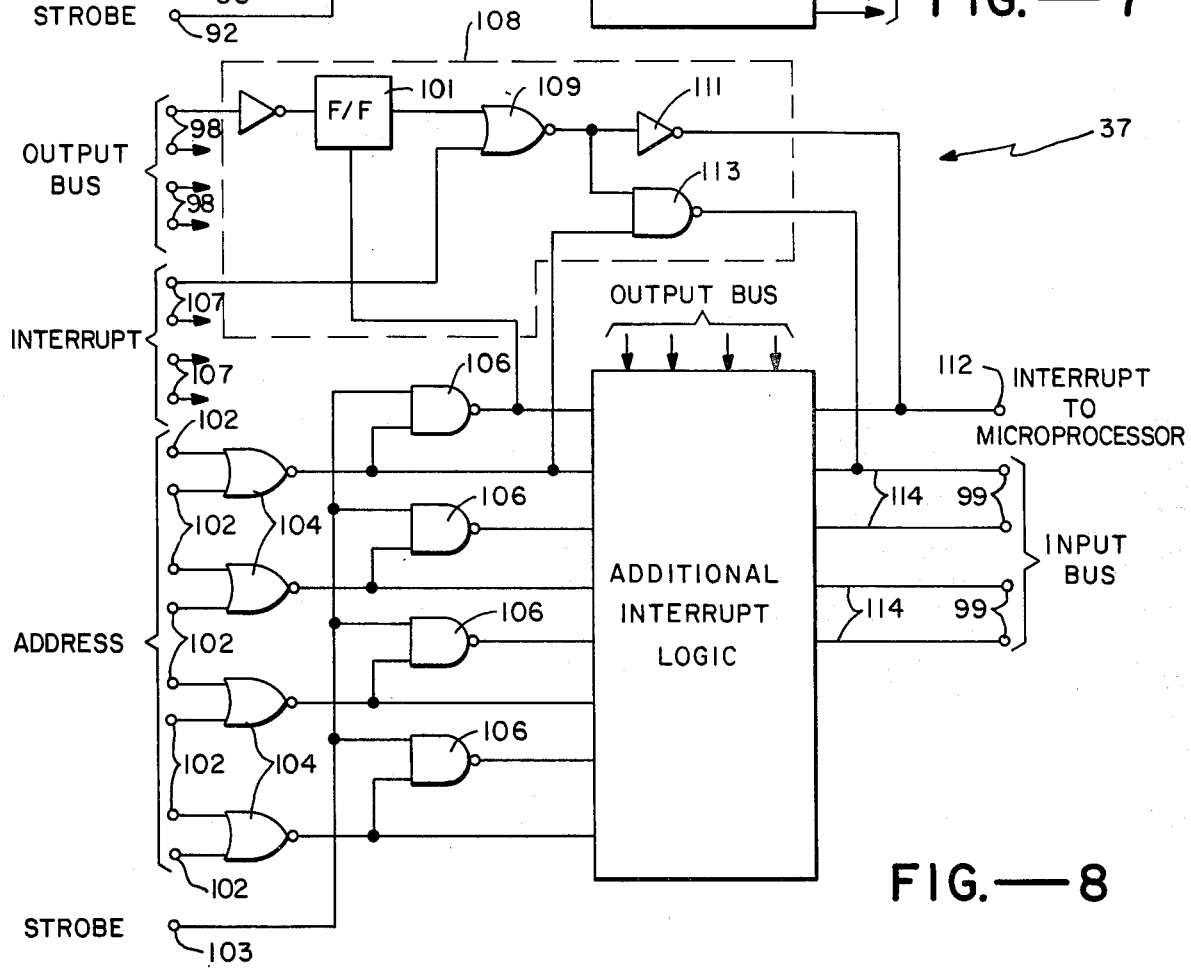
FIG. 8 is an electrical schematic diagram of an interrupt logic circuit.

The circuit of FIG. 8 discloses interrupt logic circuitry 37 coupled between output bus 33 and the input bus 26 through output bus terminals 98 and input bus terminals 99 respectively. Output data is coupled from output bus terminals 98 to the input of a flip-flop 101 which is actuated by address inputs from input/output interface 27 to address terminals 102 and a strobe input to strobe terminal 103 through NOR gates 104 and NAND gates 106 as described above for lamp driver circuit of FIG. 7 and the relay driver and output buffer circuit of FIG. 6. A group of interrupt terminals 107 receive the interrupt signals from terminals 59 at the input buffer circuit 24 shown in FIG. 5. A single interrupt signal path 108 is shown in FIG. 8 with an input signal from terminal 98 to flip-flop 101, a clock signal from NAND gate 106 coupled to flip-flop 101, and an input on a NOR gate 109 being connected to one of the interrupt terminals 107. Another input to NOR gate 109 is from the output of flip-flop 101. In the event two low input states are applied to the inputs of NOR gate 109 a high output state is provided at the output thereof which is inverted in inverter 11 and connected to an interrupt terminal 112. In the circuit embodiment of FIG. 8 the low state signal at an interrupt terminal 107 will produce a low state at interrupt output terminal 112 which will interrupt microprocessor 32. A NAND gate 113 has a pair of inputs coupled to the output of NOR gates 104 and 109 so that when a interrupt signal is to interrupt output terminal 112 an input data bit is produced at the output of NAND gate 113 and coupled to one of four lines 114 connected to input bus terminals 99 for coupling input data to input bus 26. This is for the purpose of the microprocessor 32 being able to poll the interrupt lines to determine which interrupt needs to be serviced.

As shown in FIG. 8 output data from output bus 33 is also connected to additional interrupt logic circuits containing individual paths similar to single path 108 for interrupt signal processing. In brief, the way the circuit functions is as follows. The appearance of any kind of an interrupt input 107 will key the microprocessor 32 to begin the interrupt routine. This causes the system to examine the interrupt inputs four at a time by setting up the proper address lines 102 for a specific NOR gate 104 which enables NAND gate 113 and since the output from flip-flop 101 is initially low, the interrupt signal transfers through NOR gate 109 to the input of NAND gate 113 thereby placing any interrupt signals directly onto input bus terminals 99. The processor reads these and as they are accomplished, the proper address is set up for NOR gate 104 and the input 103 is strobed providing a clock to flip-flop 101 from NAND gate 106. This, in conjunction with the proper information on the output bus terminals 98 at the time of the clock sets the output of flip-flop 101 to a logic "1" which will effectively remove that particular interrupt signal from the common interrupt output 112. This process is repeated for each interrupt input 107 until all interrupts are cleared and all interrupt software routines are executed. In the present system eight separate switches producing interrupt signals are envisioned. All of these switches are on elevator car 14 and include the following: the leveling switches up and down as a single input to bring the car level into the floor landing, the step up and step down switches located one slow-down distance for elevator car 14 from a selected floor landing, the intermediate step up and step down switches (for fast traveling elevator cars), the collapsable safety edge switch on the elevator car door closing edges, the door zone switch indicating when the elevator car 14 is within the zone where elevator door opening is allowable, and the photo eye switch which projects a beam across the elevator car door opening and causes the door to stop a closing motion and initiate a door re-open motion. It may appear that there is a disparity between the fact that there is one interrupt output 59 available for each input 51 and yet only eight interrupts are handled in one embodiment of the interrupt scheme. This is done to keep the input buffer boards 24 totally general to allow selecting of any particular input as an interrupt if system considerations deem it necessary. It is important to note that the interrupt system is an option and is used where the speed of the elevator dictates its necessity. The criterion for its use is whether the total time around the total program loop 21, 22, 23 would cause a particular input to be missed during any of the contact scans 39, 41.

Figure 9:
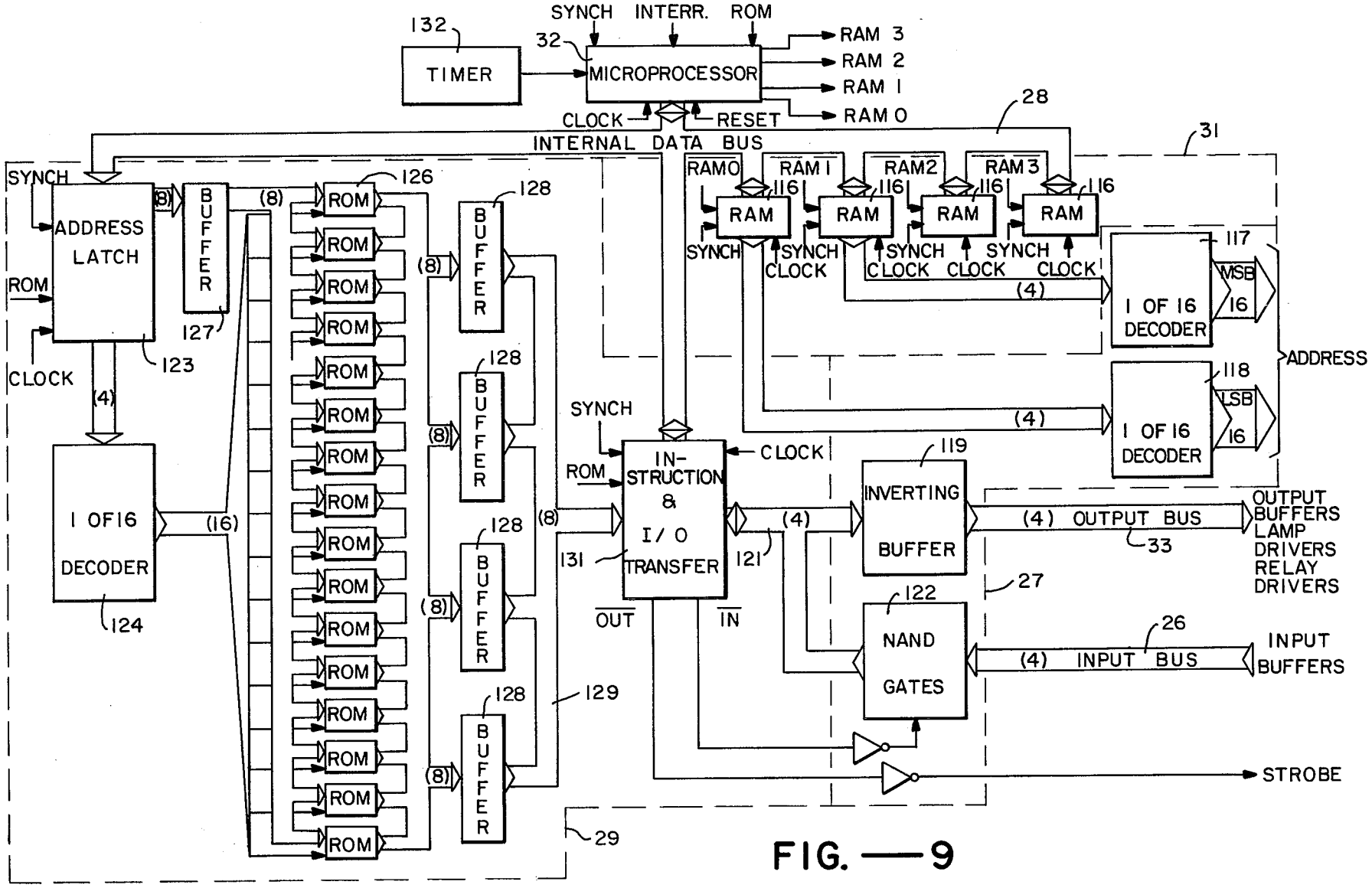
FIG. 9 is a block diagram of the computing section of the supervisory control system of FIG. 3.

The block diagram of FIG. 9 shows a more detailed breakdown of the input/output interface 27, control memory 29, data memory 31 and microprocessor or data processor 32 shown in FIG. 3. The embodiment of FIG. 9 shows a block relationship configuration where the various component blocks are readily available commercially. The particular components used herein are as follows:

Microprocessor 32; Intel* 4040
Control Memory 29;
  Read only memories (ROM) Intel 1702A
  Address Latch; Intel 4008
  Decoder; Fairchild* 9311
  Buffers: Fairchild 7407
  Instruction and I/O Transfer; Intel 4009
Data Memory 31; Random Access Memory (RAM)
  Intel P 4002-1
  Intel P 4002-2
Input/output interface 27;
Decoders Fairchild 9311
Inverting buffer Fairchild 7406
NAND Gates Fairchild 7401

*Trademark

The foregoing components require the interconnections shown in FIG. 9, but it is pointed out that different component packages from those recited above may result in interconnections different from but equivalent to those of FIG. 9 as long as the basic components recited in FIG. 3 are present.

Microprocessor or data processor 32 produces a series of program functions directing certain operations on data in the internal data bus 28 and calling for input data to be transferred to the internal data bus 28 from input bus 26 as well as transferring data on internal data bus 28 to the output bus 33. Data on the internal data bus is therefore modified by the input data, data fetched from stores, by program instructions, or by some combination of the foregoing as follows. Data memory 31 includes a plurality of random access memories (RAM) 116 coupled to the internal data bus 28. A bit position is allocated in RAMS 116 for each bit of input information. During the contact scan routine 39 seen in FIG. 4, signals external to the supervisory control system 11 are observed, and that is the only time they are observed. During the rest of the program functions of FIG. 4 following total call contact scan 39 and car status contact scan 41, any inputs which are observed by the supervisory control system 11 are fetched from the location in RAM 116 corresponding to the status of that input bit at the time of the contact scan routines 39 and 41. This is done to "stop action" input data until an entire program function routine is accomplished. Car call switches 17 and hall call switches 12 when read by the supervisory control system 11 write a one into the appropriate bit position in the random access memory 116 if energized, but do not write a zero into that bit position if not energized. A zero may be inserted into that bit position later in the program function routine. All other inputs to the supervisory control system 11 when read and energized write a one into the appropriate bit position in RAM 116 and if not energized write a zero into that bit position.

The various data buses in FIG. 9 carry multiple information data bits. The numbers in parenthesis indicate the number of data bits for that bus. Input/output interface 27 provides an address output from 1 of 16 decoders 117 and 118 shown coupled to output ports on two of the RAMS 116. This is logically the equivalent of the configuration shown in the block diagram of FIG. 3. Decoders 117 and 118 provide a most significant bit output and a least significant bit output respectively. It may be seen that there exists a capability for 256 addresses coupled to the various output buffers 34, lamp drivers 36, interrupt circuits 37 and input buffers 24.

Input/output interface section 27 also includes an inverting buffer 119 receiving and passing output data from an input/output bus 121 to output bus 33. Also included within interface section 27 is a group of NAND gates 122 operating to couple input data from input bus 26 to input/output bus 121.

The control memory or program memory 29 is coupled to the internal data bus 28. Program memory 29 has an address latch 123 receiving address data from the internal data bus 28. Address latch 123 provides a four bit address to 1 of 16 decoder 124. Decoder 124 in turn provides the one out of 16 outputs for enabling one out of 16 read only memories (ROM) 126. Address 123 provides 8 bits of address information to a buffer 127 which in turn connects the 8 address bits to ROMS 126. A plurality of program instructions are fixed in ROMS 126 and the addressed program instruction in 8 bit format at the output of ROMS 126 through buffers 128 to a program instruction bus 129. An instruction and I/O transfer device 131 receives the 8 bits of information from program instruction bus 129 transferring it to internal data bus 28. Instruction and I/O transfer device 131 also provides an $\overline{in}$ output coupled to NAND gates 122 for bringing input data from input bus 26 into input-/output bus 121 for transfer to internal data bus 28. An $\overline{out}$ output from instruction and I/O transfer device 131 is provided as the strobe output to relay drivers 34, lamp drivers 36, and interrupt logic circuits 37. As discussed above, the strobe output serves to transfer data from the output bus to the enabled control outputs for the circuits 34, 36 and 37.

Microprocessor 32 has a reset input actuated during the start sequence 18 of the program routine of FIG. 4 and a clock input.The interrupt input discussed above occurring at output terminal 112 of the interrupt circuit of FIG. 8 is also coupled to microprocessor 32. A synchronize output and a ROM enable output are also provided from microprocessor 32 which are coupled to various portions of the supervisory control system 11. Microprocessor 32 further provides RAM $\theta$ enable outputs coupled to inputs of the random access memories 116. A timer 132 is connected to microprocessor 32 for providing a real time base for timer update data directed by microprocessor 32 to data memory 31.

Figure 10:
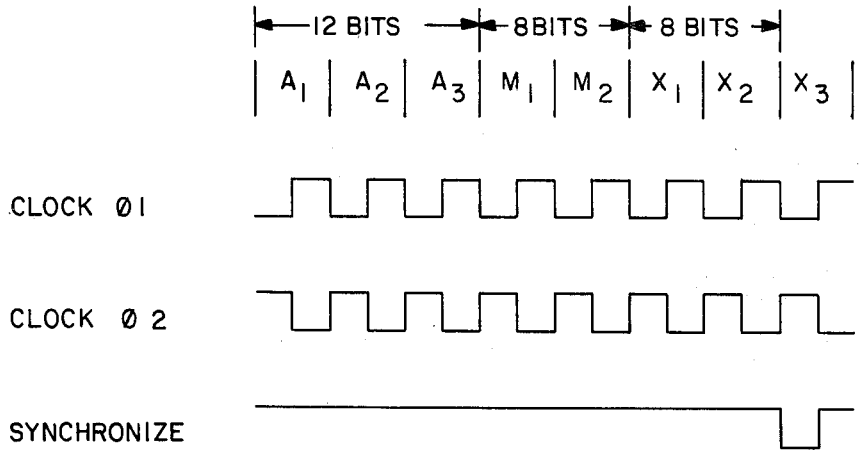
FIG. 10 is a timing diagram showing one instruction cycle for the micro-processor of FIGS. 3 and 9.

A typical instruction cycle including serial functions performed by microprocessor 32 is seen in FIG. 10. Clock inputs are shown coupled to address latch 123, instruction and I/O transfer device 131, microprocessor 32 and RAMS 116. Clock inputs are shown as $\phi 1$ and $\phi 2$ having output cycle lengths within the approximate range of 1.3 to 2 microseconds. An entire instruction cycle is performed in the range of 10 to 16 microseconds. Since an elevator is a continuous real time machine the supervisory control system 11 operates in a closed loop performing the predetermined pattern of instructions serially presented by microprocessor 32 many times each second. It is seen that the speed of performing instruction is such that the control functions appear to be continuously monitored.

In this embodiment the first three instruction periods in the instruction cycle of FIG. 10 are labeled A1, A2 and A3. Twelve bits of information are transferred by the microprocessor 32 from data bus 28 to address latch 123. The first four bits of information are transmitted to decoder 24 to pick a unique one out of 16 ROMS 126. The next eight bits of address information coupled to address latch 123 are transmitted through buffer 127 to pick a unique set of program instructions in the addressed ROM 126. The unique set of program instructions are passed through buffers 128 to program instruction bus 129. The following instruction M1 transfers the first four bits of the program instruction appearing on bus 129 to internal data bus 28 where they are available and absorbed into microprocessor 32. M2 in the instruction cycle absorbs the second four bits of the program instruction into microprocessor 32 in like fashion. The execute periods within the program cycle X1, X2 and X3 next occur, within which microprocessor 32 executes the program instruction. Complete program cycles are used to fetch stored input data from RAMS 116 to the internal data bus 28 by appropriate combination of pulses on the RAM 0 to RAM 3 lines. Using additional program cycles, data on the internal data bus 28 is thereafter transferred through instruction and I/O transfer device 131, input/output bus 121 and inverting buffer 119 to apper as output data on output bus 33. Microprocessor 32 further instructs instruction and I/O transfer device 131 to provide an $\overline{in}$ signal coupled to NAND gates 122. Consequently, input data from input bus 26 is passed through NAND gates 122 to input/output bus 121 and instructions and I/O transfer device 131 to internal data bus 28. Input data is thereby made available to microprocessor 32. Appropriate combinations of pulses on RAM 0 to RAM 3 lines cause the input data temporarily stored in microprocessor 32 to be passed onto internal data bus 28 to be stored within RAMS 116.

By way of summary, the following is an explanation of the signal path routing for typical input and output signals in the system. This is the manner in which the transfer of information is accomplished through the supervisory control system 11 from the system floor landing select switch 12 or car mounted select switch 17 is pushed to the time the read back lamp in that select switch or call button illuminates in response to system acknowledgment of the selection. This involves passage of information through an input buffer 24 and into the supervisory control system 11, where a signal will then be generated and passed back out through a lamp driver 36, so that the lamp is illuminated. The information flow through a relay driver 34 will not be discussed since the flow of information between a relay driver 34 and the microprocessor 32 is identical to the flow through a lamp driver 36.

Beginning with a contact closure on the first floor car mounted select switch 17 on the elevator car operating panel, potential from the smooth 120 VDC bus is routed onto the wire corresponding to the first floor car call button input which is ultimately connected to an input terminal for this call on the controller itself. From there, the potential is routed to an input terminal 51 seen in FIG. 5 on an input buffer circuit 24, and propagates therethrough as an enabling signal to NAND gate 61. At a point during the portion of the overall program called total contact scan 39 of FIG. 4, where it is desired to check for the presence of the input used in this example, a plurality of program instructions cause microprocessor 32 to write a pair of four bit directions to each of two four bit ports, which are located on, but do not operate as part of, two of the random access memory (RAM) chips 116. These two four bit characters comprise the most significant bit code (MSC) and least significant bit code (LSC). The codes are divided into two sets of 16 lines each by one of 16 decoders 117 and 118 making one set of 16 lines the MSB lines and the other set of 16 lines the LSB lines. Since the one of 16 decoders 117 and 118 can have only one of the 16 lines active, and if the 16 LSB lines and 16 MSB lines are thought of as making up an addressing matrix which is 16 characters by 16 characters, it is then clear that any one of the 256 possible points in the 16 by 16 character matrix may be uniquely addressed by an MSC and LSC. It is important to note that each unique address point in the 16 by 16 character matrix actually addresses a four bit character, so that the total number of bits which are addressable in the input/output system is 16 by 16 by four, equivalent to 1024 bits.

The LSB lines and MSB lines are available at the input/output interface 27. All relay driver boards 34, lamp driver boards 36, and input buffer boards 24 are identical and interchangeable in this embodiment. In spite of the fact that any of the boards which are a specific board type are identical, it is possible to place any of the four bit input or output characters on any of the foregoing board types on any point in the 16 by 16 character matrix. This is accomplished by hard-wiring the correct pairs of LSB and MSB lines to specific board positions in the supporting board or card cage. This has the effect of assigning inputs and outputs to specific points in the 16 by 16 character matrix due to their card positions in the card cage. System flexibility is thereby accomplished by hard-wire options on the card cage backplane, and not by changes on the plug-in circuit boards themselves. The LSB and MSB line pairs connected to terminals 63 of FIG. 5 and addressing the four bit character containing the input used in this example, will cause the output of the correct NOR gates 62 of FIG. 5 to go to a high state. This will allow the actual status of the input to appear on the output of NAND gate 61 which is presented on one of the terminals 66 of FIG. 5 and connected to one of the four lines comprising input bus 26. The status of the three other inputs addressed in this four bit character also appear on the remaining lines of input bus 26 in similar fashion. The desired signal then appears as an enabling input to one of the NAND gates 122 seen in FIG. 9, the other enabling input of which is obtained from an inverted version of the $\overline{in}$ signal emanating from the instruction and I/O transfer device 131 of FIG. 9. The $\overline{in}$ signal strobes the desired signal along with three other bits through NAND gates 122 onto input/output bus 121, where the instruction and I/O transfer device 131 has been properly configured to propagate the data directly through onto the internal data bus 28 where it enters microprocessor 32 and is read.

In the contact scan routine 39 of FIG. 4 the input data character just received is logically "ORed" with a corresponding four bit character from RAM 116. The result is accumulated and is subsequently written back into the same location in RAM 116. Next, an address corresponding to the desired point in the 16 by 16 input/output address matrix is written to the ports on RAM's 116 where they propagate through the one of 16 decoders 117 and 118 as the address bits for MSB and LSB. Microprocessor 32 then takes the accumulated contents and produces this as an output onto the internal data bus 28, where the four bit character propagates through the instruction and I/O transfer device 131 onto I/O bus 121 through the inverting buffers 119 of FIG. 9 to the output bus 33. At substantially the same time, the instruction and I/O transfer device 131 places a signal on its $\overline{out}$ line which is routed through an inverter and presented as the strobe signal, as shown in FIG. 9. The desired output character which has been placed on output bus 33 is now available at terminals 84 of the lamp driver circuit detailed in FIG. 7. The desired bit contained in this character is present at the input of flip-flop 87. The proper pair of address lines MSB and LSB have been hard-wired to the input of the correct NOR gate 91 through terminals 88 of FIG. 7, and with the strobe input on terminal 92 energized, the desired enabling signal is propagated through the correct NAND gate 89. The output of the correct NAND gate 89 clocks the flip-flop 87 for the desired lamp driver output as well as the other three flip-flops 87 corresponding to the flour bit character being addressed. The desired data is then latched into flip-flop 87 which then gates the input of silicon controlled rectifier CR2, causing current to flow through the corresponding output terminal 93, through the wiring in the controller elevator hoistway and traveling cable, where the same current eventually flows through the lamp in the fixture behind the push button that initiated the foregoing chain of events.

A detailed computer program for controlling the operating of the data processing system of FIG. 1 is cancelled from this specification as published, but is included in the application on file in the United States Patent Office as Appendix I and comprises part of the disclosure.

TABLE I

| HEXADECIMAL | | | | NMEMONIC | | Title: |
|---|---|---|---|---|---|---|
| Page ADR | Line ADR | Instr. | Label | Instruction Operation | Operand | Direction Selection Comments |
| 6 | 20 | D1 | | LDM | 1 | |
| 6 | 21 | B3 | | XCH | 3 | |
| 6 | 22 | D8 | | LDM | 8 | Get FRM at 218 |
| 6 | 23 | B1 | | XCH | 1 | |

TABLE I-continued

| HEXADECIMAL Page ADR | Line ADR | Instr. | Label | NMEMONIC Instruction Operation | Operand | Title: Direction Selection Comments |
|---|---|---|---|---|---|---|
| 6 | 24 | 50 | | JMS | | |
| 6 | 25 | 22 | | | RAM fetch (2) | |
| 6 | 26 | A0 | | LD | 0 | |
| 6 | 27 | 14 | | JCN | AC=0 | |
| 6 | 28 | 42 | | | Check SUA(502) | |
| 6 | 29 | F7 | | TCC | | Save Carry (up/down cycle info) |
| 6 | 2A | B7 | | XCH | 7 | |
| 6 | 2B | A8 | | LD | 8 | |
| 6 | 2C | FA | | STC | | This builds 8E if car 1 or 8F if car 2 C or A (8 in IRU from FRM fetch) to get FRM return floor |
| 6 | 2D | F6 | | RAR | | |
| 6 | 2E | FA | | STC | | |
| 6 | 2F | F6 | | RAR | | |
| 6 | 30 | F2 | | IAC | | |
| 6 | 31 | B1 | | XCH | 1 | |
| 6 | 32 | 3A | | FIN | 5 | Loads Fire Service Return Floor into IRB |
| 6 | 33 | A7 | | LD | 7 | Load cycle info |
| 6 | 34 | 14 | | JCN | AC=0 | |
| 6 | 35 | 3A | | | | Work more on down Test up/down cycle |
| 6 | 36 | A9 | | LD | 9 | |
| 6 | 37 | 9B | | SUB | B | See if PI ≦ FRM Return Floor IR9 = PI (carry is cleared from TCC at 629) Y = O if PI ≦ 143 |
| 6 | 38 | 18 | | JCN | Unconditional | |
| 6 | 39 | 3C | | | Test Inq. | |
| 6 | 3A | AB | Work on Down | LD | B | |
| 6 | 3B | 99 | | SUB | 9 | See if PI ≧ FRM Return Floor CY = OY ≧ 1Y2 |
| 6 | 3C | F7 | Test Inq. | TCC | | |
| 6 | 3D | B7 | | XCH | 7 | Restore Carry cycle pointer |
| 6 | 3E | F6 | | RAR | | |
| 6 | 3F | A7 | | LD | 7 | |
| 6 | 40 | 14 | | JCN | AC=0 | |
| 6 | 41 | 4B | | | Check slow down | |
| 6 | 42 | 22 | check SUA(SDA) | FIM | 1 | |
| 6 | 43 | 3C | | 3C | | |
| 6 | 44 | DO | | LDM | 0 | |
| 6 | 45 | B7 | | XCH | 7 | |
| 6 | 46 | D2 | | LDM | 2 | |
| 6 | 47 | 55 | | JMS | | |
| 6 | 48 | 05 | | | Mirror Right | |
| 6 | 49 | 50 | | JMS | | Get SUA (SDA) at 302 (341) I/O |
| 6 | 4A | 60 | | | I/O Fetch | |
| 6 | 4B | A0 | | LD | 0 | |
| 6 | 4C | 14 | | JCN | AC=0 | |
| 6 | 4D | SC | | | Reset DMU (DMO) | |
| 6 | 4E | 22 | check slow downs | FIM | 1 | |
| 6 | 4F | 11 | | 11 | | |
| 6 | 50 | D4 | | LDM | 4 | |
| 6 | 51 | 55 | | JMS | | |
| 6 | 52 | 05 | | | Mirror Right | |
| 6 | 53 | 50 | | JMS | | Get USDI (DSDI) 3114 (112) |
| 6 | 54 | 20 | | | RAM Fetch | |
| 6 | 55 | AO | | LD | 0 | |
| 6 | 56 | B7 | | XCH | 7 | |
| 6 | 57 | AO | | LD | 0 | |
| 6 | 58 | 14 | | JCN | AC=0 | |
| 6 | 59 | 5C | | | Reset DMJ(DMD) | |
| 6 | 5A | D3 | | LDM | 3 | |
| 6 | 5B | 10 | | SKP | | |
| 6 | 5C | DO | reset DMU (DMD) | | 0 | |
| 6 | 5D | BO | | XCH | 0 | |
| 6 | 5E | 22 | | FIM | 1 | |
| 6 | 5F | 26 | | 26 | | |
| 6 | 60 | D2 | | LDM | 2 | |
| 6 | 61 | 55 | | JMS | | |
| 6 | 62 | 05 | | | Mirror Right | |
| 6 | 63 | 50 | | JMS | | |
| 6 | 64 | 40 | | | RAM UPDATE | UPDATE DMU (DMD) 3262 (261) |
| 6 | 65 | DB | | LDM | B | ADDR 2B6 |
| 6 | 66 | B3 | | XCH | 3 | |
| 6 | 67 | D1 | | LDM | 1 | ADDR 2B1 |
| 6 | 68 | B1 | | XCH | L | |
| 6 | 69 | 50 | | JMS | | |
| 6 | 6A | 22 | | | RAM FETCH (2) | Get H @ 2B1 |
| 6 | 6B | A0 | | LD | 0 | |

TABLE I-continued

| HEXADECIMAL Page ADR | Line ADR | Instr. | Label | NMEMONIC Instruction Operation | Operand | Title: Direction Selection Comments |
|---|---|---|---|---|---|---|
| 6 | 6C | 14 | | JCH | AC=0 | |
| 6 | 6D | 72 | | | Door Zone Test | |
| 6 | 6E | A7 | | LD | 7 | 7 contains 0 if no Demand 4 if DMU, 2DMD |
| 6 | 6F | 1C | | JCN | AC=0 | |
| 6 | 70 | 84 | | | Set SU(SD) | |
| 6 | 71 | C0 | | BBL | 0 | |
| 6 | 72 | 22 | Door Zone Test | FIM | 1 | |
| 6 | 73 | 13 | | 13 | | |
| 6 | 74 | 50 | | JMS | | |
| 6 | 75 | 20 | | | RAM FETCH | Get Door Zone |
| 6 | 76 | A0 | | LD | 0 | |
| 6 | 77 | 1C | | JCN | AC=0 | |
| 6 | 78 | 82 | | | Reset SU(SD) | |
| 6 | 79 | C0 | | BBC | 0 | |
| 6 | 7A | | | | | |
| 6 | 7B | | | | | |
| 6 | 7C | | | | | |
| 6 | 7D | | | | | |
| 6 | 7E | | | | | |
| 6 | 7F | | | | | Fetch Del 3144 |

Figure 16:
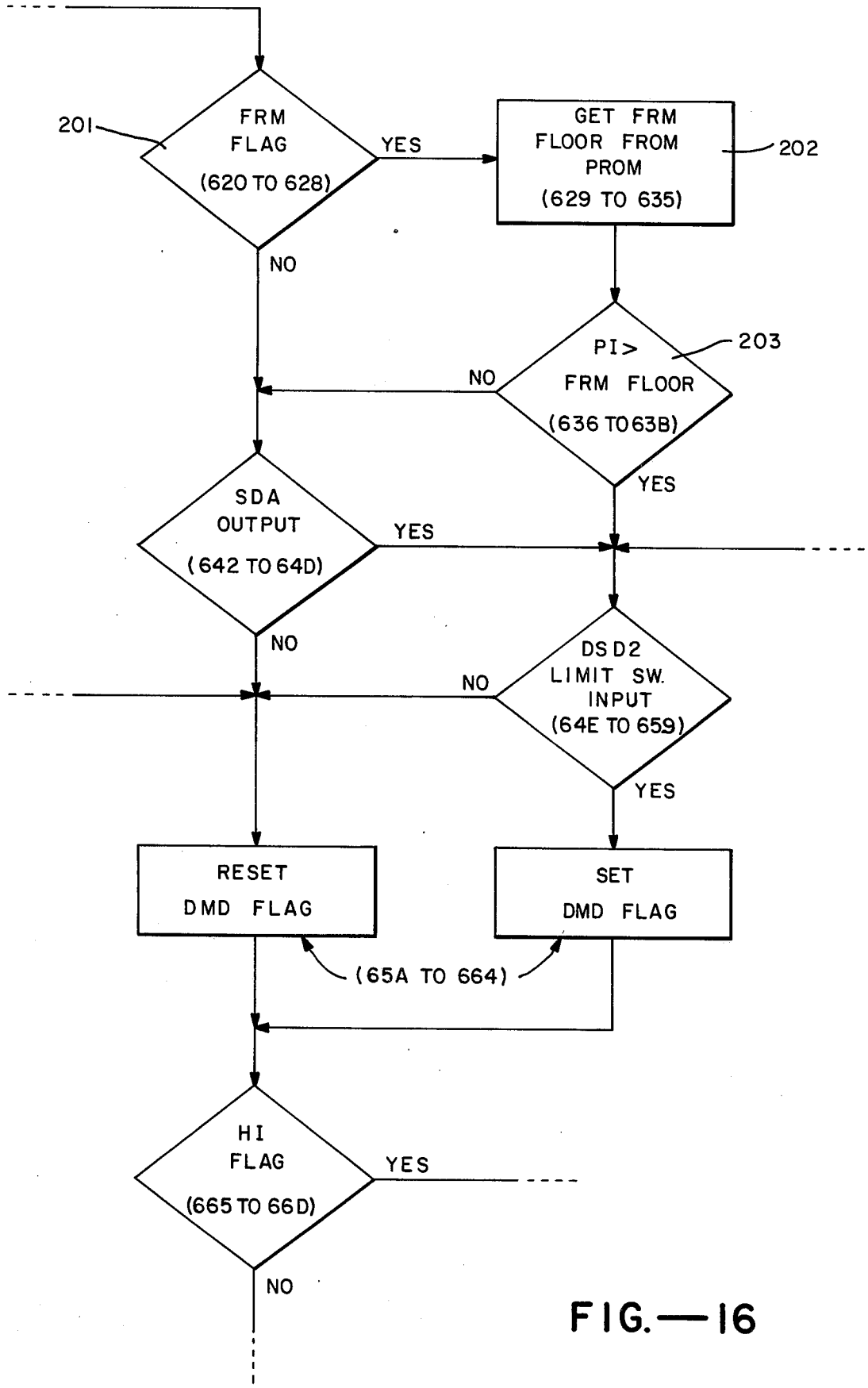
FIG. 16 is a flow chart of a portion of the direction selection processing subroutine of the disclosed method.

FIG. 16 of the drawings corresponds to the sub-routine of TABLE I. Throughout the description of the direction selection processing sub-routine, the lines of code will be referred to by their hexadecimal address set forth in TABLE I. The first line is 620, followed by line 621, etc.

Lines 620 through 623 of TABLE I place the address of the internal fireman's service operation (FRM) flag into microprocessor 32 index registers. A sub-routine RAM fetch is called by lines 624 and 625 and performs the actual data memory input and masking, so that after a register load instruction (line 626) the accumulator is left with the desired bit in a field of zeros. Lines 627 and 628 perform the branch 201 as indicated in FIG. 16. Lines 629 through 632 create an address needed for an indirect fetch of the FRM return floor value from RAM, as seen in block 202 of FIG. 16.

This portion of the program is written so that it processes either up or down information depending upon the state of the microcprocessor internal carry flip-flop. Lines 633 through 641 change the sense of the comparison of the comparison of position indicator to FRM floor represented by branch 203 of FIG. 16, depending on the direction being processed. Lines 642 through 648 create an address to fetch SUA (Supervisory Up Auxilliary). "Mirror Right", seen in TABLE I is a sub-routine which shifts the mask used in flag fetches to again allow one block of code to process either up or down information through the use of indirect addressing. Lines 649 and 64A call the fetch sub-routine. Note that this is an I/O fetch, rather than RAM fetch as in lines 624 and 625. In this system, means are provided, such as NAND gate 77 of FIG. 6 or NAND gate 96 of FIG. 7, for reading the status of an external output driver latch as though it were a memory location. In this way the true status of all outputs is available for use as processor input, as well as requiring less hardward for storing the many flags required. Lines 64B through 64D perform a branch on SUA status.

Lines 64E through 657 fetch a flag from data memory corresponding to the status of the up-slow-down limit switch as of the last system "snap-shot". Lines 658 and 659 branch if this input is zero. Note that lines 65A and 65B set up the internal index registers to set the DMD (Demand Down) flag, while lines 65C and 65B set up the same registers to reset the DMD flag. Since the branch instruction located at lines 658 and 659 can only select one or the other of these two options, it is obvious that on every pass through the program the processor forces the DMD flag to its proper condition, as seen in lines 65E through 664. Thus, the system is forced to the proper output state on every program loop, regardless of noise induced switching of output latches. This programming method provides a signicant safety margin when operating in an adverse environment. This design philosophy is used throughout the disclosed system.

Figure 11:
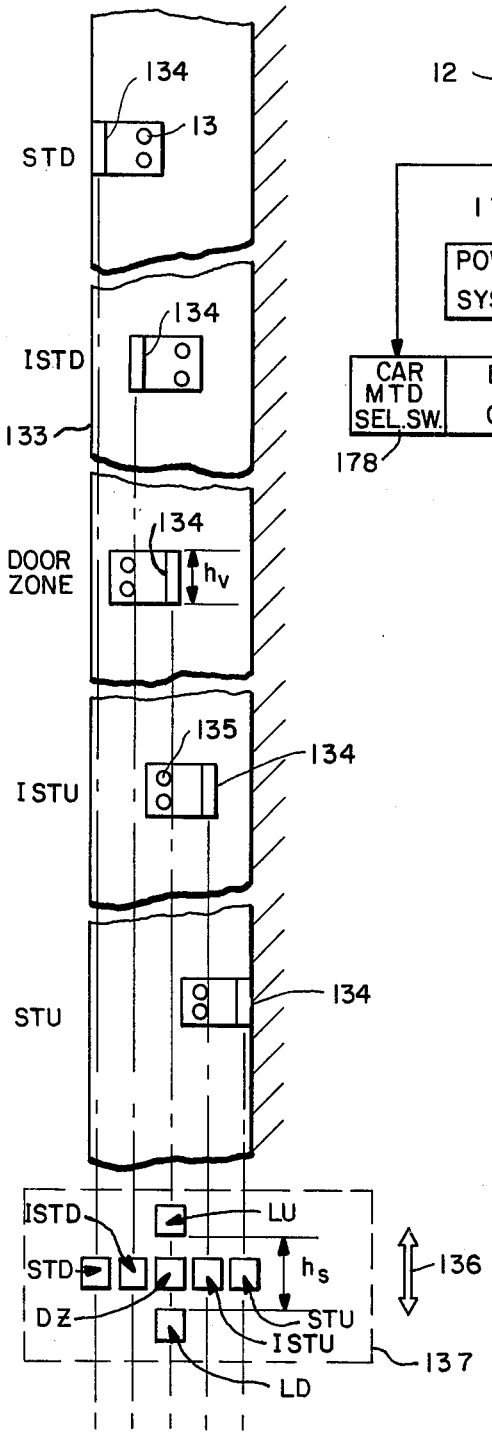
FIG. 11 is a broken elevational view of a vane arrangement in the elevator hoistway and vane switch arrangement on the elevator car.

FIG. 11 shows an arrangement of vanes mounted in a hoistway for elevator car 14. A vane channel 133 is mounted in a vertical direction along one surface of the hoistway having a plurality of projecting vanes 134 extending therefrom. Vanes 134 are shown mounted to vane channel 133 by appropriate means such as screws 135. In this embodiment the vane channel 133 has a slot running the full length of the front surface, and mounting screws 135 pass through this slot and are secured to a small plate contained within the vane channel 133. In this way, the vertical position of any vane 134 is easily adjustable by simply loosening mounting screws 135 without removing them and sliding the vane 134 to the proper vertical position. FIG. 11 shows vanes 134 in a position such that the outermost ends of the vanes 134 are depicted. Vane channel 133 is shown as broken between each vane 134 for the purpose of showing that the height proportion in the direction of arrow 136 relative to separation between the vanes 134 is not to scale. Note that vanes 134 are in different vertical "lanes". A plurality of magnetic switches marked by appropriate designation letters are included in a car top controller 137 carried on elevator car 14. The magnetic switches are aligned with specific lanes for vanes 134. A step down vane (STD) 134 is aligned with magnetic switch STD in car top controller 137. An intermediate step down vane (ISTD) 134 is aligned with magnetic switch ISTD. A door zone vane (DZ) 134 is aligned with three magnetic switches for level up (LU), door zone (DZ) and level down (LD). An intermediate step up vane (ISTU) 134 is aligned with magnetic switch ISTU. A step up vane (STU) 134 is aligned with magnetic switch STU. The magnetic switches in this embodiment are the type which are held open by a cancellation of opposing magnetic fields carried with the switch contacts and are closed when one of the vanes 134 are interposed between the magnetic switch and one of the carried magnetic fields.

A stepping function such as 43 in FIG. 4 is performed by magnetic switches STD, ISTD, ISTU and STU. When the car top controller 137 traveling in an up direction brings magnetic switch STU level with STU vane 134, magnetic switch STU closes and if the floor landing which elevator car 14 is approaching has been selected by means of registering hall calls 12 or car calls 17, the supervisory control system 11 is optionally interrupted and floor position stepping occurs as described hereinbefore, initiating the dropping out of high speed, and the power control system 13 then begins a slowdown in preparation for elevator car 14 to approach the upcoming floor landing. Still presuming elevator car 14 to be traveling in an upward direction as indicated by arrow 136 DZ vane 134 causes magnetic switch LU to close about eight inches from the floor, alerting supervisory control system 11, and the power control system 11 brings elevator car 14 level with the selected floor landing. In addition, the DZ switch is also caused to close at plus or minus 4 inches of the floor. The height of the DZ vane 134 is less than the distance between the LU and LD magnetic switches hs. Consequently while DZ vane 134 is causing DZ magnetic switch to close, if the elevator car 14 is level with the floor, the DZ vane 134 is not effecting the magnetic switches LU and LD and they remain open. Door operation for elevator car 14 occurs while the car is level within plus or minus four inches of the selected floor landing and while DZ switch is closed. For downward travel indicated by arrow 136 the function of STD vane 134 together with STD magnetic switch and LD magnetic switch is as described for STU and LU magnetic switches respectively hereinabove.

Elevator car 14 may in some installations reach speeds of up to 500 feet per minute or more. Vanes 134 may be about eight inches tall. This means that at top speed elevator car 14 will cause the magnetic switches to pass by vanes 134 in about 80 milliseconds. As recited before the entire program function routine of FIG. 2 for a single car is about 100 to 150 milliseconds. A duplex system requires about 200 to 250 milliseconds. Therefore the interrupt signal must be presented quickly as explained in the description of interrupt logic 34 in FIG. 6 of the drawings, and is in fact presented in one embodiment in the first ten milliseconds as the STU and STD vanes 134 pass magnetic switches STU and STD respectively. When the level up or level down magnetic switches reach DZ vane 134 and if a slowdown has been initiated, control of elevator car 14 is released by supervisory control system 11 and car motion is thereafter controlled by the LU and LD magnetic switches until the DZ vane 134 is centered therebetween and elevator car 14 is brought to a stop with the car floor level with the floor landing and the brake set.

ISTD and ISTU vanes 134 work in conjunction with ISTD and ISTU magnetic switches in car top controller 137. They are utilized when the slow down distance for elevator car 14 is more than one half floor landing away from the floor at which a stop has been selected by hall call switches 12 or car call switches 17. This is a feature which is necessarily incorporated in some high speed elevator systems. The function of vanes 134 is to obtain high intermediate speed control once a slowdown has been initiated. In the highest speed control systems the ISTU and ISTD switches also implement a stepping reset function as part of the overall stepping scheme.

Figure 12:
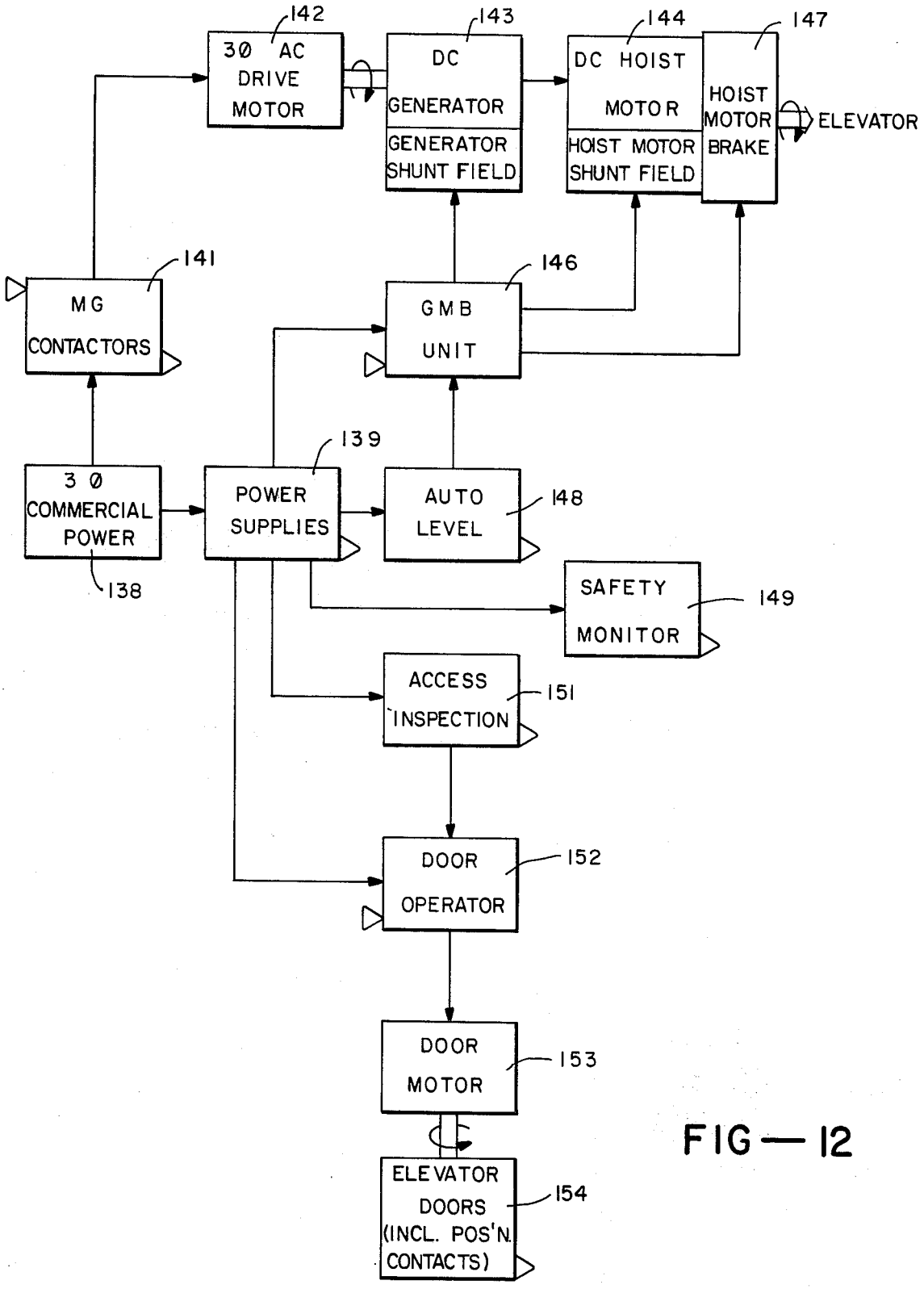
FIG. 12 is a block diagram of the power control system.

FIG. 12 is a block diagram of the power control system 13. As shown, a three-phase AC commercial power source 138 energizes a group of power supplies 139 providing power to the supervisory control system 11 as shown by the triangle attached to power supply block 139. The specific power supplies for supervisory control system 11 are shown as item No. 38 in FIG. 3 of the drawings. The three-phase power source 138 is also connected to an array of motor generator contactors 141 which are controlled by inputs from the supervisory control system 11 and which provide status inputs to the supervisory control system 11. The motor generator contactors 141 are arrayed in a fashion to provide a wye three-phase connection to an AC drive motor for starting and to thereafter provide a delta three-phase connection to the three-phase drive motor 142 for running. Supervisory control system 11 also provides a shut-down signal to the three-phase drive motor 142 through the motor generator contactors 141. Three-phase motor 142 drives DC generator 143 which provides armature current for a DC hoist motor 144 which drives elevator car 14 up and down the elevator hoistway.

Power supplies 139 supply one of the three AC phases from commercial power supply 138 to a generator-motor-brake (GMB) unit 146. One of the outputs of GMB unit 146 is connected to the generator shunt field for DC generator 143 which directly controls the output of the DC generator 143 and provides the primary speed control for DC hoist motor 144. Three-phase drive motor 142 drives DC generator armature at a relatively constant speed and therefore DC generator output is roughly proportional to generator shunt field excitation. DC generator 143 therefore provides a high current amplification function, roughly of the order of 100. GMB unit 146 also provides field excitation for the shunt field on DC hoist motor 144. The strength of the shunt field for hoist motor 144 is maintained within a relatively narrow range in this embodiment, and is not the primary control in adjusting for DC hoist motor load.

GMB unit 146 also provides an output to a coil assembly attached to spring loaded brake shoes appearing in FIG. 12 as hoist motor brake 147. When the power control system 13 selects the braking function, the power is removed from the hoist motor brake coils which allow the springs to force the brake shoes against the rotating portion of DC hoist motor 144. A power failure accomplishes the same end result, resulting in a fail-safe system.

Power supply 139 also is connected to automatic leveling device 148. The level up and level down relays are included in automatic leveling device 148 together with certain contacts which provide the input to the GMB unit 146. The automatic leveling device functions when the supervisory control system 11 is not in control of car motion.

A plurality of safety monitors 149 are provided which are powered by power supply 139. The safety monitors 149 include the door lock "string" which is a group of series connected contacts which all must be made prior to elevator car 14 being urged away from a floor landing after having made a floor landing stop. The door zone switches and position limit switches are included here which are generally standard equipment in an elevator system, and are mentioned here only for a description of the equipment with which the supervisory control system 11 and power control system 13 function. The safety monitor also includes primary direction relays, potential relays (which must be engaged for the elevator to move at all), speed enabling and speed relays, the MPR relay, MG set pilot relays for MG contactors 141, safety relays, etc. The contacts on these relays exist throughout the controller for the purpose of assuring safe operation of the control system as well as providing interface function between portions inside the power control 13 and between power control 13 and any point outside. Power supply 139 also provides power to access and inspection equipment 151 which has an output to the supervisory control system 11 for the purpose of cutting data processor 32 out of the system while access is gained to the elevator car top or the elevator is run manually in the inspection mode from a control panel which is generally located at the top of elevator car 14.

Power supply 139 further supplies a door operator unit 152 which receives an output from supervisory control system 11. Door operator unit 152 drives a DC motor 153 which in turn is coupled through linkage and gearing to elevator doors 154 on elevator car 14. The status of elevator door 154 is transmitted to the supervisory control system 11 as indicated.

Figure 13:
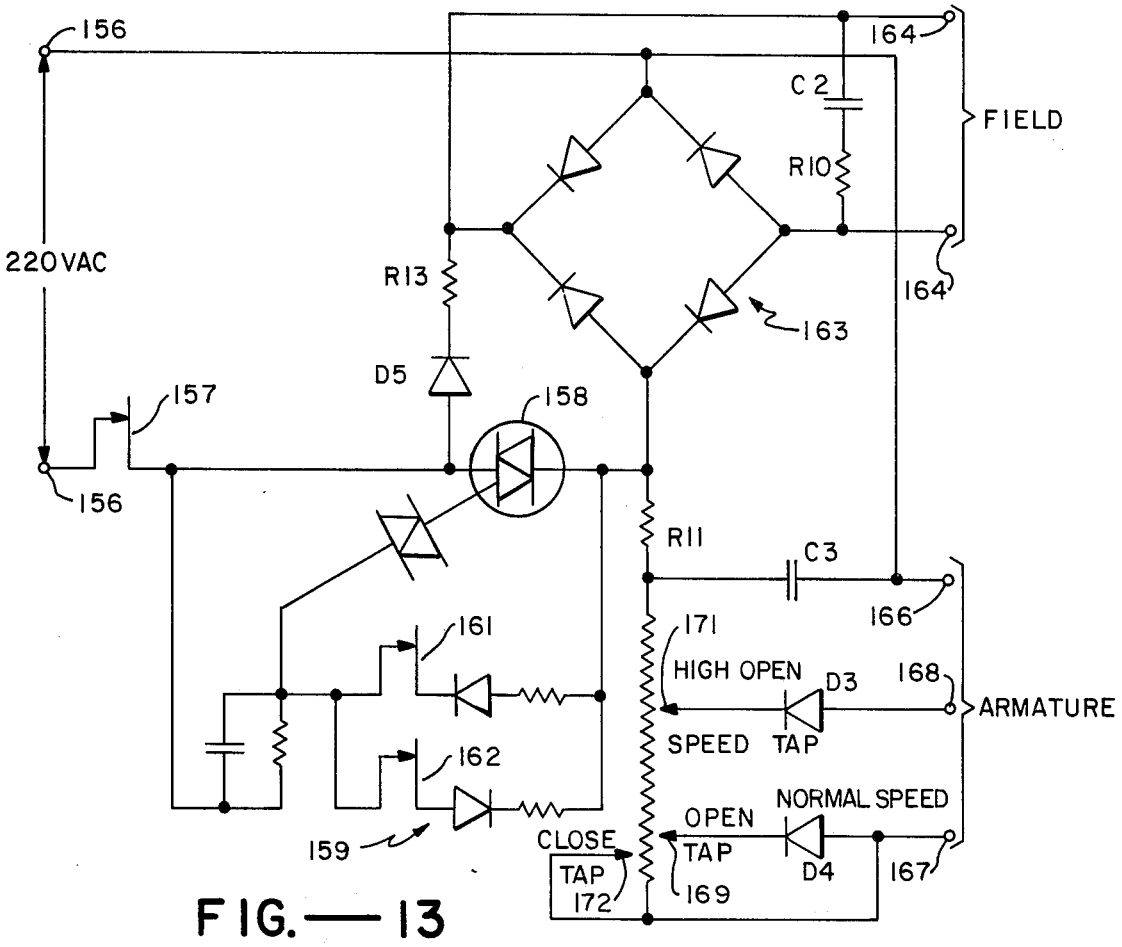
FIG. 13 is an electrical schematic diagram of the door operator unit shown in FIG. 12.

Turning now to FIG. 13 a schematic diagram is shown of the door operator unit 152. As stated above 220 volt single phase power is delivered to door operator unit 152 at input terminals 156. A safety relay contact 157 is located in one of the 220 volt AC input lines which is normally open, but which is energized to a closed condition when the elevator control system is energized and in a safe condition. A solid state triac 158 is located in one of the 220 volt AC input lines. A gate circuit 159 for triac 158 is provided in which is disposed a door close relay (DC) contact 161 and a door open relay (DO) contact 162. Relay contacts DC 161 and DO 162 are normally open and are closed by a control output signal from supervisory control system 11 for a door close and a door open operation respectively. A diode bridge 163 is provided between the 220 volt AC terminals 156 so that a predetermined polarity of field current for door motor 153 is provided at field terminals 164. The field current is smoothed by a series connection of resistance R10 and capacitor C2 between terminals 164.

When DC relay 161 is energized to a closed condition current is passed through triac 158 in one direction and when DO relay 162 is energized to a closed condition the current is allowed to pass through triac 158 in the opposite direction. Current passing through triac 158 is in the form of a half-wave and is smoothed by the RC network including resistance R11 and capacitor C3. The smoothed current passing through triac 158 when DO relay 162 is actuated to a closed condition is applied to terminals 166 and 167, and 168 over a portion of door travel, which terminals are coupled to the armature of door motor 153. A control external to the circuit of FIG. 13 is provided for selecting power to door motor 153 through terminals 166 and 167 for normal door opening speed and between terminals 166 and 168 for high door opening speed. An adjustable tap 169 is provided on a resistance R12 for adjustment of normal door opening speed. Another adjustable tap 171 is provided on resistance R12 for adjustment of high door opening speed. When DC relay 161 is energized current is passed through triac 158 in a direction opposite to that when DO relay 162 is actuated to a closed condition, and armature current to door motor 153 is passed through terminals 166 and 167 to close the elevator door. An adjustable tap 172 is provided on resistance R12 to adjust the door closing speed. Diodes D3 and D4 prevent current from passing through taps 171 and 169 respectively during door closing. When DC relay 161 is closed door closing current is passed through tap 172, terminal 167, the armature of door motor 153 and terminal 166. A diode D5 and resistance R13 are provided to pass a standing value of door motor field current through terminals 164 to keep door motor 153 in a warmed operating condition. It should be noted that no power is applied to armature terminals 166, 167 and 168 when both DC relay 161 and DO relay 162 are in the open condition.

Figure 14:
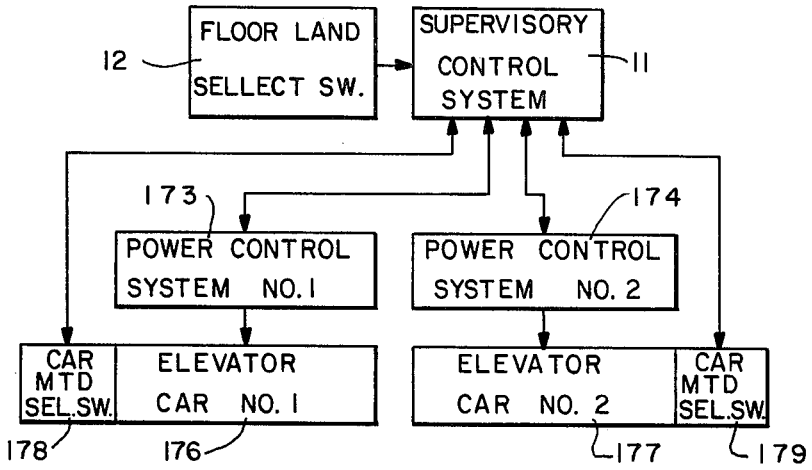
FIG. 14 is a block diagram of a duplex elevator car control system.

FIG. 14 shows a block diagram for the control system disclosed herein having the capability of controlling two elevator cars 14. Floor landing select switches 12 are present providing switch contact information to supervisory control system 11. First and second power control systems 173 and 174 are coupled to a supervisory control system 11. Power control system 173 controls a first elevator car 176 and power control system 174 controls a second elevator car 177. A group of car mounted select switches 178 and 179 are carried in first and second elevator cars 176 and 177 respectively. Car mounted floor landing select switches or car call switches 178 and 179 are coupled to supervisory control system 11 to provide input data thereto as hereinbefore described.

Figure 15:
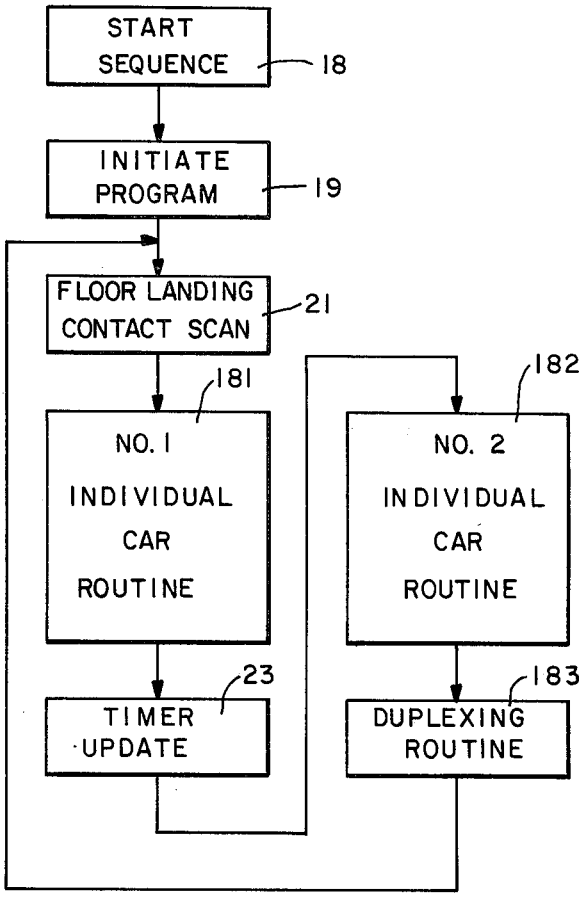
FIG. 15 is a program flow diagram for the system of FIG. 14.

A program function flow diagram is shown in FIG. 15 for the duplex system of FIG. 14. Start sequence 18 and initiate program 19 are as described for FIG. 2 and 4 above. Floor landing contact scan 21 is performed as described for the program flow diagram of FIG. 2. A first individual elevator car routine 181 is performed followed by a timer update function 23 as described for FIG. 2. A second individual elevator car routine 182 is performed similar to that of FIG. 4, followed by a duplexing routine 183. A program routine cycle for the duplex system of FIG. 14 is shown in FIG. 15 including the floor landing contact scan subroutine 21, the duplexing subroutine 183, and all subroutines therebetween. The first and second elevator cars 176 and 177 are controlled to provide efficient operation by duplexing routine 183. When inactive, the elevator cars 176 and 177 are placed such that one of the cars is at the lobby and is deemed the "parked" car while the other car is either left at the floor where it answered its last call or is returned to a predetermined floor and is deemed the "free" car. The "free" car is available to answer all calls except those at the lobby where the parked car is located, while the "parked" car cannot respond to hall call demand except the lobby calls. Under conditions of light traffic demand, the parked car is retained at the lobby unless a car call takes it elsewhere. At the onset of hall call demand, the free car can respond immediately while the parked car can be conditionally released which would place both cars "on line" to hall call demand for a continuous period of time by the duplexing routine 183 until such time as the hall call demand ceased, reinstating the parking function. The conditional release involves releasing one of the elevator cars 176 or 177, whichever is the parked car, to answers an up or down hall call above a down traveling "free" elevator car. The conditional release also provides that the parked elevator 176 or 177 will be released to respond to an up hall call which is registered below an up traveling free elevator car. Another condition for release of the parked car is that continuous hall call demand is retained in excess of the approximate time it takes for the free elevator car to make one full excursion in the hoistway from the top to the bottom floor landing. Consequently, satisfying any of the aforementioned criteria for the conditional release of the parked car allows both elevator cars 176 and 177 to answer any up or down call in the system until such time that a gap occurs in the hall call demand, thereby causing a supervisory control system L11 to return one of the elevator cars 176 or 177 to the lobby and re-establish it in the "parked" condition.

An elevator car control system has been disclosed which will handle one, or a pair of elevator cars, which provides a control program which is alterable by reprogramming of read only memories, and which eliminates a large number of ponderous electro-mechanical relay components and connections thereto.

What is claimed is:

1. An electronic control system for controlling indicator and drive components for an elevator in a hoistway responsive only to control output signals of a relatively high predetermined voltage level resulting from elevator car command and status inputs at said high voltage level, said command and status inputs being responsive to and dependent on the command for the status of said elevator at any given time in its operation, comprising input buffer means located in a remote vicinity of said hoistway and coupled to receive the command and status inputs for converting all of the latter to input data at a relatively low predetermined voltage level, means for receiving output data all of which is at said low voltage level and converting the latter to said high voltage level control output signals in response thereto, interface means for receiving and transmitting said input and output data therethrough, a data memory coupled to said interface means to receive and store said input data, a program memory coupled to said interface means and having a plurality of program instructions therein, a data processor providing serial functions coupled to said program and data memories and said interface means, said data processor operating in continuous cycles, each in accordance with a predetermined program routine to determine the status of said input data, to store said input data in said data memory, to fetch stored input data in accordance with said program, to formulate output data in accordance with said program and fetched stored input data, and to transfer said output data through said interface means to said means for receiving output data for providing said control output signals and controlling said indicator and drive components, whereby each system input is read during each program routine cycle, and each system output is set or reset as appropriate during the same cycle.

2. An electronic control system as in claim 1 wherein said interface mans includes a decoder, said serial functions operating to couple stored input data to said decoder, said decoder providing an address output corresponding to stored input data and coupled to said input buffer means and said means for receiving output data to enable addressed output data at said means for receiving output data, and addressed command and status inputs at said input buffer means, whereby corresponding control output signals and input data are provided respectively.

3. An electronic control system as in claim 1 together with a lamp driver coupled to said input and output data , said interface means including a decoder, said serial functions operating to couple stored input data to said decoder, said decoder providing an address output corresponding to stored input data and coupled to said input means, said means for receiving output data, and said lamp driver, which enables addressed output data at said means for receiving output data and said lamp driver and addressd command and status inputs at said input buffer means, whereby random access memory locations and corresponding control output signals are provided in the former instance, and input data are provided in the latter.

4. An electronic control system as in claim 1 wherein said program memory includes a plurality of read only memories containing said plurality of program instructions, and address means providing an address output coupled to said plurality of read only memories, said serial functions being determinative of said address output thereby determining said instruction output.

5. An electronic control system as in claim 1 responsive to a plurality of elevator operation interrupt signals, said interrupt signals being coupled to said input buffer and providing interrupt data, together with interrupt logic connected to receive said interrupt input and output data, said interrupt logic being coupled to and operating to interrupt said data processor in disregard of the status of said serial functions.

6. An elevator control system for controlling an elevator in a hoistway positioned by a hoist motor generator driver connected to a power source and responsive to control output signals resulting from elevator car command and status input all of which are provided at a relatively high voltage level, comprising a generator-motor-brake control circuit providing generator field, hoist motor field, and hoist motor brake outputs at said relatively high voltage level, means for sensing elevator position relative to a floor landing and providing car position output signals at said high level and indicative thereof, an automatic leveling control responsive to said car position output signal operating to control the hoist motor in the vicinity of the floor landing, an elevator door operator circuit providing door close and door open drive signals responsive to said car position output signal at said high level, motor generator contactors disposed between the motor generator and the power source controlled between open and closed positions, input buffer means coupled to receive all of the high voltage level command and status inputs and said high level car position signal and providing relatively low voltage level input data corresponding thereto, means for receiving relatively low voltage level output data and providing said relatively high voltage level control output signals in response to output data, said control output signals being coupled to control said motor generator contactors, said generator-motor-brake control circuit, and said elevator door operator circuit, interface means for receiving and transmitting said input and output data therethrough, a data memory coupled to said interface means operating to store said input data, a program memory having a plurality of program instructions therein, and a data processor coupled to said program and data memories and said interface means, said data processor operating cyclically through a program routine to address said program memory, to obtain instruction output therefrom in accordance with addressed ones of said plurality of program instructions, to read said instruction output, to fetch stored input data in accordance with said instruction output, to formulate output data with fetched stored input data, to transfer said output data through said interface means to said output buffer means, and to couple stored input data to said interface means, so that an address is produced corresponding to transferred stored input data, said address output being coupled to said input buffer means and said means for receiving output data to thereby enable addressed output data at said means for receiving output data and provide said control output signals to enable addressed command output signals to enable addressed command and status inputs, door drive signals, and car position output at said input buffer means during each program routine cycle, whereby the elevator operation is selective collective automatic in the hoistway, the elevator is leveled at commanded floor landings, and the elevator doors are operated in accordance with input and output data.

7. A control system comprising car control means including indicator and drive means for operating an elevator car in a hoistway only with relatively high voltage level control output signals responsive only to relatively high voltage level elevator car command and status inputs which are responsive to and dependent on the command for and status of said elevator car at any given time in its operation, said car control means including an input buffer means for receiving the command and status inputs and providing corresponding input data at a relatively low voltage level, in input bus means for receiving said input data, an output bus means for receiving relatively low voltage level output data, a relay driver means connected to said input and output busses for providing the control output signals in accordance with output data, a lamp driver means connected to said input and output busses for providing relatively high voltage level lamp output signals in accordance with output data, a data bus means, an input/output interface means connected to said input, output and data busses for providing a relatively low voltage level address output data connected to said input buffer, said relay driver, and said lamp driver, a data memory means connected to said data bus for storing input data, a control memory means connected to said data bus for providing relatively low voltage level instruction data, a data processor means connected to said data bus for providing periodic serial instructions to transfer said input data to said data bus means through said input/output interface means, to store said nput data in said data memory means, to address said control memory means to obtain corresponding instruction data therefrom, to transfer said instruction data to said data bus means, to fetch said stored input data from said data memory means in accordance with said instruction data, and to transfer data on said bus means, through said input/output interface means to said bus means, said address output enabling addressed output data, whereby relatively high voltage level control and lamp output signals are provided by said relay and lamp drivers respectively in accordance with said address output.

8. A control system as in claim 7 wherein the indicating and driving components provide a plurality of interrupt signals coupled to said input buffer means and providing interrupt data, an interrupt circuit connected to said input and output bus means to receive said interrupt data and to provide an interrupt output in response thereto, said interrupt output being coupled to said data processor means to stop said periodic serial instructions immediately on receipt.

9. A control system as in claim 7 together with reset means connected to said data processor means, said reset means serving to clear said data memory and to reinitiate said periodic serial instructions.

10. In an apparatus having a control system for controlling an elevator car and including a data memory storing input data, a program memory providing program instructions, and a data processor serially processing stored input data in accordance with the program instructions providing output data which is energized for a set period of time, a power control system including a hoist motor coupled to an elevator car in a hoistway, a door operator coupled to doors on the elevator car, an automatic level device aligning the elevator car with floor landings, power control system contact interconnecting power control system components and coupling the power control system with the supervisory control system, hall and car selectable contacts, and hall and car indicator lights, the method comprising the steps of initially interrogating all hall, car, and power control system contacts with the data processor, thereby obtaining input data, storing all of said input data in said data memory, selecting an elevator car travel direction dependent on and in response to contact interrogation data in said memory, initiating a slow down of the elevator car approaching a floor landing depending on and in response to hall and car contact interrogation data in said memory, leveling the elevator car at the floor landing in accordance with the automatic leveling device, said initiating a slowdown and leveling steps occurring for selected car contacts in the order in which the corresponding floor landings are reached without regard for the direction of travel, and occurring for selected hall contacts in the order in which the selected floor landings are reached in accordance with the direction of travel, cancelling the stored input data which is in said memory and which corresponds to the selected hall and car contacts for the floor landing to which the elevator car was last leveled, actuating the door operator to open and hold the elevator car doors open for a predetermined time dependent on and in response to said cancelled data, at the end of said time actuating the door operator to close the elevator car doors, moving the elevator car from the floor landing with the hoist motor at an operating speed determined by and in response to the data output, energizing selected hall and car indicator lights in accordance with output data; and re-energizing the output data by means of the data processor at intervals less than the set time period, whereby failure to re-energize causes the data processor outputs to be isolated from the power control system.

11. The method of claim 10 wherein the control system includes an earthquake sensor providing an earthquake output coupled to the control system, including the steps of stopping the elevator car immediately in response to the earthquake output, starting and moving the elevator car into an adjacent floor landing, leveling the elevator car at the floor landing, opening the elevator car doors, and stopping the elevator car operation.

12. The method of claim 10 wherein the data memory includes a plurality of data memory timing locations, and a clock providing period clock output coupled to the data memory, including the step of sensing the contact closures resulting from stepping the elevator car into the floor landing, selecting one of the plurality of data memory timing locations in accordance with the sensed contacts closures, advancing each selected one of the data memory timing locations with each clock period, so that the output data controls the door operator, whereby the predetermined elevator door open time is dependent on the manner in which the elevator car is selected to stop at the floor landing.

13. The method of claim 10 wherein the apparatus includes an additional power control system controlling an additional elevator car in an additional hoistway, an additional door operator coupled to doors on the additional elevator car, an additional automatic leveling device aligning the additional elevator car with the floor landings, additional power control system contacts interconnecting additional power control system components and the control system, additional car selectable contacts and additional car indicator lights, the additional steps of interrogating the additional car and power control system contacts with the data processor, selecting a travel direction for the additional elevator car dependent on contact and additional contact interrogation, starting and moving the additional elevator car into a floor landing depending on hall and car contact and additional car contact interrogation, leveling the additional elevator car at the floor landing in accordance with the additional automatic leveling device, said starting and moving and leveling steps occurring for selected additional car contacts in the order in which the corresponding landings are reached without regard for the direction of travel, and occurring for selected hall contacts in the order in which the selected floor landings are reached in accordance with the direction of travel, determining and directing the additional elevator car direction of travel dependent on output data, cancelling the stored input data corresponding to the selected hall and additional car contacts for the floor landing to which the additional elevator car was last moved, actuating the additional door operator to open and hold the additional elevator car doors open for a predetermined period of time, actuating the additional door operator to close the additional elevator car doors, urging the additional elevator car from the floor landing at an operating speed determined by the data output, energizing selected hall and additional car indicator lights in accordance with the output data, releasing a parked elevator car conditionally upon occurrance of up or down selected hall contacts above a down travelling elevator or additional elevator car, releasing a parked elevator car conditionally upon occurrance of up selected hall contacts below an up travelling elevator or additional elevator car, and suscepting the elevator and additional elevator cars to continuous selected hall contact demand for a predetermined period of time before complete release, whereby the elevator and additional elevator cars are coordinated to service the floor landings efficiently.

14. The method of claim 10 together with the steps of clearing the data memory to remove residual stored data when power is initially applied, finding the elevator car in the hoistway, and matching the supervisory control system with the physical elevator car hoistway position.

15. The method of claim 14 wherein the steps of finding the elevator car when it is not at the top or bottom landing, and of matching the supervisory control system with the elevator car position, comprises the steps of transferring top and bottom floor landing absence input data into the supervisory control system, processing an elevator running bit into the output data, running the elevator car to a terminal floor landing in accordance with the output data, and synchronizing the supervisory control system with the elevator terminal floor position.

16. A system for controlling an elevator car in a hoistway, comprising first means located in the vicinity of said elevator car and hoistway for producing command and status input signals in response to and dependent on the command for and status of said car at any given time in its operation, all of said command and status input signals being produced at a relatively high voltage level;

second means isolated from said vicinity for converting all of said high voltage level command and status input signals to input data signals of a relatively low voltage level;

third means isolated from said vicinity for producing output data signals in response to and dependent upon said input data signals and a predetermined computer program, all of said output data signals being produced at a relatively low voltage level and said third means including said computer program;

fourth means isolated from said vicinity for converting all of said low voltage level output data signals to control output signals of relatively high voltage level; and fifth means located in said vicinity and responsive to said output signals for operating said elevator car.

17. An electronic control system as in claim 16 including power supply means for energizing said output data signals for a set time period, wherein said second means includes means for re-energizing the output data signals at intervals less than the set time period and wherein said third means provides said control output signals only when said output data signals are energized, whereby failure to re-energize said output data prevents said output signals from being provided.

18. A system according to claim 14 wherein said computer means includes means for at least once successively determining the status of each of said command and status input signals and placing all of said responsive input data signals in memory before providing said output data signals and wherein said output data signals are provided in response to said input data signals as placed in memory.

19. A system according to claim 18 wherein said status determining means continuously cyclically successively determines the status of each of said command and status input signals and places all of said responsive input signals in memory and sets or resets said control output signals each cycle.

20. A control system for at least one elevator car urged to move in a precontrolled manner in a hoistway by motive apparatus ultimately responsive to power signals initiated by elevator car command and status inputs produced in response to and dependent on the command for and status of said elevator at any given time in its operation, comprising:

means operating to continuously cyclically scan said command and status inputs for providing intermediate energizable signals each scan cycle, said intermediate signals being responsive to and dependent on said command and status inputs and a predetermined program routine, power supply means for energizing said intermediate signals at the beginning of operation of said system for a set period, at the end of which said intermediate signals de-energize unless prior to the end of said period said intermediate signals are re-energized, means responsive to and dependent on intermediate signals when the latter are energized for producing said control output signals, means for coupling said control output signals to said motive apparatus, and means for re-energizing said intermediate signals at intervals less than said period, whereby failure to re-energize said intermediate signals prevents said output signals from being produced.

21. A system according to claim 20 wherein said set period is greater than one of said scan cycles and wherein said interval less than said set period is approximately equal to said scan cycle.

22. A control system according to claim 20 wherein said scanning means scans at a rate substantialy higher than the response time of the elevator car and motive apparatus, so that each command and status input is read and each intermediate signal is set or re-set each scanning cycle, whereby control output signals induced by spurious signals are set or re-set prior to elevator car and motive apparatus response.

* * * * *